US011472595B1

(12) United States Patent
Rhodes et al.

(10) Patent No.: US 11,472,595 B1
(45) Date of Patent: Oct. 18, 2022

(54) DISPLAY CONTAINER

(71) Applicant: Packaging Corporation of America, Lake Forest, IL (US)

(72) Inventors: Jonathan Harold Rhodes, Montville, NJ (US); Steven Toffler, Elmhurst, IL (US); Carmine Bucalo, Mooresville, NC (US); Keith A. Jackson, Round Lake, IL (US)

(73) Assignee: Packaging Corporation of America, Lake Forest, IL (US)

( * ) Notice: Subject to any disclaimer, the term of this patent is extended or adjusted under 35 U.S.C. 154(b) by 688 days.

(21) Appl. No.: 16/434,044

(22) Filed: Jun. 6, 2019

Related U.S. Application Data

(60) Provisional application No. 62/849,370, filed on May 17, 2019, provisional application No. 62/684,634, filed on Jun. 13, 2018.

(51) Int. Cl.
*B65D 5/34* (2006.01)
*A47F 3/14* (2006.01)
*B65D 5/54* (2006.01)

(52) U.S. Cl.
CPC ..... *B65D 5/325* (2013.01); *A47F 3/14* (2013.01); *B65D 5/542* (2013.01)

(58) Field of Classification Search
CPC ..... B65D 5/325; B65D 5/443; B65D 5/323; B65D 5/542; A47F 3/14
USPC ..... 206/45.29
See application file for complete search history.

(56) References Cited

U.S. PATENT DOCUMENTS 5,016,814 A * 5/1991 Fullerton ..... B65D 5/308 229/196
5,657,872 A * 8/1997 Leftwich ..... B65D 5/325 206/766
6,481,619 B1 * 11/2002 Jackson ..... B65D 5/002 206/509
6,604,675 B2 * 8/2003 Southwell ..... B65D 5/0035 229/164
6,712,214 B1 * 3/2004 Wintermute ..... B65D 5/006 206/745
6,719,191 B1 * 4/2004 Christensen ..... B65D 5/0075 206/509
7,467,743 B1 * 12/2008 Philips ..... B65D 5/0045 229/196
7,607,567 B2 * 10/2009 Fry ..... B65D 5/0281 229/178
8,622,282 B2 * 1/2014 Brundage ..... B65D 5/6605 229/160

(Continued)

FOREIGN PATENT DOCUMENTS

WO WO 2017/120463 7/2017

*Primary Examiner* — Ernesto A Grano
(74) *Attorney, Agent, or Firm* — Klarquist Sparkman, LLP

(57) ABSTRACT

A display container for shipping and displaying product includes a removable panel portion that, when removed, opens a display opening in the container. The container has outer walls reinforced by interior liner panel sections. The display container desirably includes interior corner gussets that add to the vertical crush resistance or stacking strength of the container. The display container is desirably formed from a single piece corrugated paper board blank and is designed so that it can be assembled into a container knock down state in one pass through a box forming machine.

45 Claims, 10 Drawing Sheets

(56) References Cited

U.S. PATENT DOCUMENTS

| | | | | |
|---|---|---|---|---|
| 8,955,677 | B2 * | 2/2015 | Ladler-Dennis | B65D 5/4229 229/116.1 |
| 9,061,791 | B2 * | 6/2015 | Cameron | B65D 5/443 |
| 9,145,228 | B2 * | 9/2015 | Bevier | B65D 25/005 |
| 9,156,578 | B2 * | 10/2015 | Smith | B65D 1/225 |
| 9,505,516 | B2 * | 11/2016 | Hubbard, Jr. | B65D 5/2057 |
| 10,336,501 | B2 * | 7/2019 | Smith | B65D 5/106 |
| 2003/0226783 | A1 * | 12/2003 | Jackson | B65D 5/542 206/769 |
| 2012/0000973 | A1 * | 1/2012 | McLeod | B65D 5/6664 229/191 |
| 2013/0186892 | A1 * | 7/2013 | Ladler-Dennis | B65D 5/4229 229/116.1 |

* cited by examiner

DISPLAY CONTAINER

CROSS REFERENCE TO RELATED APPLICATIONS

This application claims the benefit of U.S. Provisional Application Ser. No. 62/684,634, entitled DISPLAY CONTAINER, filed on Jun. 13, 2018, and also claims the benefit of U.S. Provisional Application Ser. No. 62/849,370, entitled DISPLAY CONTAINER, filed on May 17, 2019.

TECHNICAL FIELD

This disclosure relates to containers that can be used both for shipping product and in displaying the shipped product.

BACKGROUND

A need exists for improved display containers comprising or consisting of corrugated paper board that can be used for both shipping product and displaying the shipped product in the container. A need also exists for such containers with enhanced vertical crush resistance or stacking strength.

SUMMARY

A display container is described that can be used both for shipping product and as a display container by removing a portion of a panel that at least partially closes a display opening of the container. The display container outer walls are reinforced by interior liner panel sections to provide enhanced vertical crush resistance or stacking strength. The display container desirably includes interior corner gussets that add to the vertical crush resistance or stacking strength. The display container is desirably formed from a single piece corrugated paper board blank and is designed so that the blank can be assembled into a container knock down state in one pass through a box forming machine during which various folds are made in the container blank. The container can be erected from the knock down state without requiring further manufacturing steps.

The container design, because of the enhanced vertical stacking strength, can be made from relatively lower weight corrugated paper board. Also, wastage of paper board during manufacture of the blank is reduced.

In accordance with an aspect of this disclosure, an embodiment of a display container can comprise first, second and third outer wall panels, each with respective exterior and interior wall panel surfaces and upper and lower wall panel edges. The first outer wall panel can comprise, define or include a display opening; which can be of a variety of shapes, such as rectangular, u-shaped, oval and open at the top, or another desired shape. In this embodiment, the second outer wall panel can be coupled to the first wall panel at a first corner and the second wall panel can be coupled to the third wall panel at a second corner. The embodiment also can comprise first, second and third inner wall panels each with a respective exterior and interior wall surface, an upper edge, a lower edge, and first and second opposed side edges. In addition, the first inner wall panel comprising a detachable wall panel section that overlays the display opening and that, when the detachable wall panel section is removed, opens the display opening. The detachable wall panel section is desirably defined by weakened lines so that it can be torn away from the first inner wall panel without the use of box cutters or other tools. In addition, the exterior surface of the first inner wall panel desirably faces and is secured to the interior surface of the first outer wall panel, the exterior surface of the second inner wall panel desirably faces and is not secured to the interior surface of the second wall panel, and the exterior surface of the third inner wall panel faces and is desirably secured to the interior surface of the third wall panel. Adhesive is desirably used to secure the surfaces to one another, but staples or other fasteners can less desirably be used instead of or in combination with adhesive. A first gusset comprising a first gusset top edge and first gusset first and second side edges is desirably included in this embodiment, wherein the first gusset first side edge is pivoted to the first side edge of the first inner wall panel and the first gusset second side edge is pivoted to the first side edge of the second inner wall panel. A second gusset comprising a second gusset top edge and second gusset first and second side edges is desirably included, wherein the second gusset first side edge is pivoted to the first side edge of the third inner wall panel and the first gusset second side edge is pivoted to the second side edge of the second inner wall panel. Pivoting can be accomplished along fold lines in a display container comprised of corrugated paper board. Desirably, at least one hinge is provided to couple the upper edge of the first outer wall panel to the upper edge of the first inner wall panel and wherein the at least one hinge is pivotal about a hinge pivot axis. The hinge pivot axis can be positioned such that the first, second and third inner wall panels and first and second gussets are pivotal about the hinge pivot axis to position the exterior surfaces of the first, second and third inner wall panels in a position facing the respective interior surfaces of the first, second and third outer wall panels.

In accordance with other aspects of this disclosure, the at least one hinge comprises first and second spaced apart hinges that each are pivotal about the hinge pivot axis. Also, a portion of the display opening is desirably positioned between the first and second hinges. In addition, the first and second hinges can be the only foldable connection between: (i) the first and second gussets, the first, second and third outer wall panels; and (ii) the first, second and third inner wall panels.

In accordance with further aspects, a plurality of bottom panels are desirably provided with each bottom panel coupled to a respective one of the lower edges of the first, second, third and fourth outer wall panels and wherein each bottom panel comprises an interior surface and an exterior surface. In addition, a first bottom panel of the bottom panels can be coupled to the lower edge of the first outer wall panel. The first outer wall panel can comprise a lower panel section and a central panel portion pivotally coupled, such as by a fold line, to the lower panel section. In addition, the central panel portion can comprise a reinforcing panel portion secured to the interior surface of the outer wall panel lower panel section and a bottom panel reinforcing panel portion projecting from the reinforcing panel section that is positioned adjacent to the interior surface of the first bottom panel portion.

In accordance with additional aspects, at least a portion of the bottom panel reinforcing panel portion desirably touches an interior surface of the first bottom panel in the erected display container. The bottom panel reinforcing panel portion can be positioned such that an exterior surface of, and desirably a major portion or all of the exterior surface of, the bottom panel reinforcing panel portion abuts the interior surface of at least the first bottom panel. Also, a gap can exist between the bottom panel reinforcing panel portion and the interior surface of the first bottom panel adjacent to the reinforcing panel portion. Also, the bottom panel reinforcing panel portion can comprises a bottom panel reinforcing panel portion gusset positioned to span the gap.

In accordance with a further aspect, the central panel portion can comprise an upper edge that abuts the lower edge of the first inner wall panel before pivoting the central panel portion relative to the lower panel section.

As a still further aspect, the display container is desirably made from a single sheet of corrugated paper board.

As yet another aspect, a display container wall for a display container can comprise: an outer wall panel comprising first and second outer wall panel side edges, an outer wall panel top edge and an outer wall panel bottom edge, the outer wall panel also comprising outer wall panel first and second side sections with respective upper and lower edges and an outer wall panel lower panel section with respective upper and lower edges, the outer wall panel comprising a display container opening, the outer wall panel also comprising a central panel portion pivotally coupled to the upper edge of the outer wall panel lower section, the central panel portion comprising a reinforcing panel portion secured to the interior surface of the outer wall panel lower panel section and a bottom panel reinforcing panel portion from the outer panel lower panel section; an inner wall panel comprising first and second inner wall panel side edges, an inner wall panel top edge and an inner wall panel bottom edge, the inner wall panel also comprising inner wall panel first and second side panel sections with respective upper and lower edges and a detachable panel section between the first and second inner wall panel first and second side panel sections, wherein the detachable panel section partially overlies the display panel opening; a first hinge coupling the upper edges of the outer and inner wall panel first side sections together and a second hinge coupling the upper edges of the outer and inner wall panel second side sections together, wherein the inner wall panel is foldable at the first and second hinges to position the outer wall first side section against the inner wall first side section and the outer wall second side section against the inner wall second side section, wherein the outer wall first side section is secured to the inner wall first side section and the outer wall second side section is secured to the inner wall second side section; and wherein detachment of the detachable panel section opens the display opening.

As another aspect, the display container wall the detachable panel section can have a first side edge coupled by a weakened line to the first inner wall side section and second side edge coupled by a weakened line to the second inner wall side section, and wherein the detachable panel section has a lower edge portion that abuts at least a portion of the interior surface of the outer wall panel lower panel section.

As other aspects, the display container wall can comprise at least one central panel hinge pivotally coupling the central panel portion to the upper edge of the outer wall panel lower section. The lower edge portion of the detachable panel section can be provided with gap at the location of the at least one hinge positioned and sized such that the interior surface of the outer wall panel lower panel section does not abut the at least one hinge.

As further aspects, a display container wall can comprise a reinforcing panel portion that comprises an upper edge and an outer wall panel lower panel section that comprises an upper edge portion that has an interior surface extending above the upper edge of the of the reinforcing panel portion. In addition, the lower edge portion of the detachable panel section can abut at least a portion of the interior surface of the upper edge portion of the outer wall panel lower panel section prior to removal of the detachable panel section.

As another aspect, the display container wall can comprise a first gusset panel coupled to the first side edge of the inner wall panel and a second gusset panel coupled to the second side edge of the inner wall panel.

As a further aspect, the display container wall according to claim 17 can desirably be made from a single piece of corrugated paper board.

In accordance with additional aspects, a display container can comprise: an outer wall comprising first and second outer wall panels that oppose one another and that each comprise a top edge, a bottom edge and first and second side edges, wherein the first outer wall panel comprises a display panel opening and comprises first and second first outer wall side sections along opposite sides of the display panel opening and a first outer wall lower section, the outer wall also comprising third and fourth outer wall panels that oppose one another and that each comprise a top edge, a bottom edge and first and second side edges, wherein the first, second, third and fourth outer wall panels are coupled together to form four corners of the display container; an inner wall comprising a first inner wall panel comprising a first inner wall top edge, a first inner wall bottom edge and first and second first inner wall side edge portions, wherein the first inner wall side section is secured to the first outer wall side section and the second inner wall side section is secured to the second outer wall side section, the first inner wall comprising a detachable panel section covering the display panel opening, whereby removal of the detachable panel section opens the display panel opening; the inner wall comprising a second inner wall panel facing the second outer wall panel and a third inner wall panel facing the third outer wall panel, each of the second and third inner wall panels comprising a top edge, a bottom edge and first and second side edges, a first gusset panel coupling the first side edge of the first inner wall panel to the first side edge of the second inner wall panel and a second gusset panel coupling the first side edge of the of the third inner wall panel to the second side edge of the of the first inner wall panel, a third gusset panel coupled to the second side edge of the second inner wall panel and a fourth gusset panel coupled to the second side edge of the of the third inner wall panel; the inner wall comprising a fourth inner wall panel section coupled to the third gusset panel and spaced by the third gusset panel from the second inner wall panel, the inner wall panel comprising a fifth inner wall panel section coupled to the fourth gusset panel and spaced by the fourth gusset panel from the third inner wall panel, and wherein the fourth and fifth inner wall panel sections are secured to the fourth outer wall panel; and wherein the gussets are each spaced from a respective adjacent corner of the display container and wherein the second and third inner wall panels are not secured to the second and third outer wall panels.

As another aspect, the fourth outer wall panel can comprise first and second outer wall panel sections that are secured together; and wherein the fourth inner wall panel section can be secured to the first outer wall panel section and the fifth inner wall panel section can be secured to the second outer wall panel section.

As further aspects, the display container can comprise a first hinge coupling the top edge of the first outer wall side section to the top edge of the first inner wall side section, and a second hinge coupling the top edge of the second outer wall side section to the top edge of the first inner wall side section. These hinges can be the only connection between the top edges of the inner wall panels and inner wall panel sections to the top edges of the outer wall panel section.

Also, a portion of the display opening can be positioned between the first and second hinges.

In accordance with yet another aspect, a single piece corrugated paperboard blank for forming a display container can comprise: an outer wall forming portion with weakened lines defining first, second, third and fourth outer wall panels and four corners of the display container when erected, the outer wall forming portion comprising upper and lower container wall edges, the first outer wall panel comprising a central panel portion that defines a display container opening, and wherein the first and fourth wall panels are positioned to oppose one another when the display container is erected and the second and third wall panels are positioned to oppose one another when the container is erected; an inner wall forming portion with weakened lines defining first, second, third, fourth and fifth inner wall panels, a first gusset panel between the first and second inner wall panels, a second gusset panel between the first and third inner wall panels, a third gusset panel between the second and fourth inner wall panels, and a fourth gusset panel between the third and fourth inner wall panels, the inner wall forming portion comprising upper and lower container wall edges, the first inner wall having weakened lines that define a removable panel portion positioned to overlie the display container opening at least in part when the display container is erected and prior to the removal of the removable panel portion, wherein each gusset panel is positioned to be spaced from and span a respective adjacent corner of display container when the display container is erected; first and second spaced apart hinge portions coupling the upper edge of the outer wall portion to the upper edge of the inner wall forming portion, the first hinge being positioned between the removable panel portion and the first gusset and the second hinge being positioned between the removable panel portion and the second gusset; and wherein, apart from the first and second hinge portions, there are no connections between the outer wall forming portion and the inner wall forming portion that prevent the movement of the gusset panels and second and third inner wall panels relative to the outer wall forming portion during erection of the display container.

As additional aspects of a corrugated paper board blank, the first outer wall panel can comprise a lower panel portion extending from the second wall panel to the third wall panel, the lower panel portion having a lower panel portion upper edge and a lower panel portion lower edge, the central panel portion having a central panel portion upper edge and a central panel portion lower edge, the blank also comprising a pivot coupling the central panel portion lower edge to the lower panel portion upper edge, the central panel portion comprising a weakened line defining a central panel portion reinforcing panel section for positioning against the lower panel portion of the erected container.

As further aspects of a corrugated paper board blank, the corrugated paper board blank can comprise a plurality of bottom forming panels coupled to the lower edge of the outer wall forming panel, and wherein the central panel portion comprises a bottom panel reinforcing portion projecting outwardly from the central panel portion reinforcing panel section for positioning adjacent to and at least partially in contact with at least one of the bottom panels in the erected container.

As still additional aspects of a corrugated paper board blank, the corrugated paper board blank can comprise a plurality of glue lines on the surface of the outer wall forming panel that forms an interior surface of the display container when erected, the glue lines being positioned to: (i) secure the inner wall forming portion to the outer wall forming portion without connecting the gussets and second and third inner wall panels to the outer wall panels; (ii) to secure the fourth and fifth inner wall panels to the fourth outer wall panel; and (iii) to secure the first inner wall panel to the first outer wall panel outside of the removable panel portion and outside of the central panel portion.

As an additional aspect, the fourth wall panel of the corrugated paper board blank can comprise first and second fourth wall panel sections sized to overlap one another when the container is erected.

As yet another aspect, a method of forming a knocked down display container from a corrugated paper board container blank, the blank comprising an outer wall forming portion with interior and exterior surfaces and an inner wall forming portion with interior and exterior surfaces, the outer wall panel forming portion defining four outer wall panels and four corners, a first of the outer wall panels comprising a central portion positioned to define a display container opening through the first of the outer walls, the inner wall forming portion comprising five inner wall panels with a respective gusset panel between a first and second, between a first and third, between the second and fourth and between the third and fifth of the inner wall panels, the first of the inner wall panel sections comprising a removable panel portion positioned to overlie the display panel opening in part; the method comprising: folding a reinforcing panel section of the central portion against an interior surface of a lower panel portion of the first of the outer wall panels with adhesive positioned between the reinforcing panel section and the lower panel portion, the folding of the central portion creating the display container opening through the first of the outer wall panels; folding the exterior surface of the interior wall forming portion against the interior surface of the inner wall forming portion of the blank with adhesive positioned at locations between the exterior surface of the inner wall forming portion and the interior surface of the outer wall forming portion other than: (i) between the second and third inner wall panels and the adjacent outer wall panels; and (ii) between the gussets and the adjacent outer wall panels; and securing the outer wall forming portion together to interconnect the four outer walls and to form a flattened knock down display container.

This disclosure includes all possible combinations and sub-combinations of the above aspects and features as well as of additional aspects and features in the drawings and in this disclosure. The foregoing and other objects, features, and advantages of the invention will become more apparent from the following detailed description, which proceeds with reference to the accompanying figures.

DETAILED DESCRIPTION

The following explanations of terms are provided to assist in understanding the present disclosure and to guide those of ordinary skill in the art in the practice of the display containers in accordance with the present disclosure. As used herein, the words "including" and "having" and their formatives have the same meaning as "comprising and its corresponding formatives. Also, the singular forms "a" or "an" or "the" include plural references unless the context clearly dictates otherwise. The term "or" refers to a single element of stated alternative elements or a combination of two or more elements, unless the context clearly indicates otherwise. The term "coupled to" (e.g. element A is coupled to element B) includes direct connection of the elements and also includes indirect connection of the elements through one or more other elements. The terms "about" and "approximately" with respect to a value or stated range or orientation, unless otherwise stated, means plus or minus ten percent of the recited value, range or orientation.

In examples described with reference to directions indicated as "above," "below," "upper," "lower," "top", "bottom", "ascending", "descending", and/or the like; these terms are used for convenient description, but do not imply or require any particular spatial orientation. For example, a wall panel described as having a top edge is typically oriented in use with the top edge above the bottom of the container. If the orientation is changed such that the container, for example, is upside down so that the bottom of the container faces up, the container wall still has a top edge, even though it is now oriented in a lower position. The term "and/or" is to be broadly construed to include all possible combinations of elements or items with which the term is used, as well as the elements or items individually. The term "adjacent" means two components are positioned without other components being positioned between the adjacent portions of the two components. Unless explained otherwise, all technical and scientific terms used herein have the same meaning as commonly understood to one of ordinary skill in the art to which this disclosure belongs. The examples are illustrative only and not intended to be limiting, unless otherwise indicated. Other features of the disclosure will be apparent from the following detailed description and in any claims found in this application.

Figure 1:
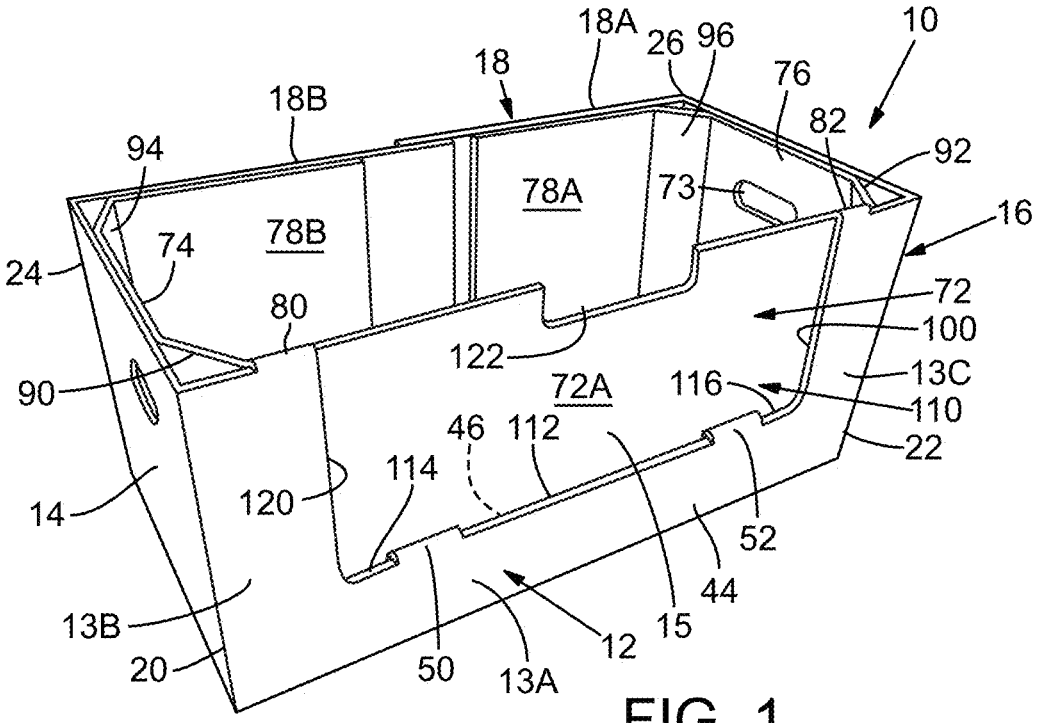
FIG. 1 is a perspective view of a display container in accordance with an embodiment of this disclosure.
Figure 2:
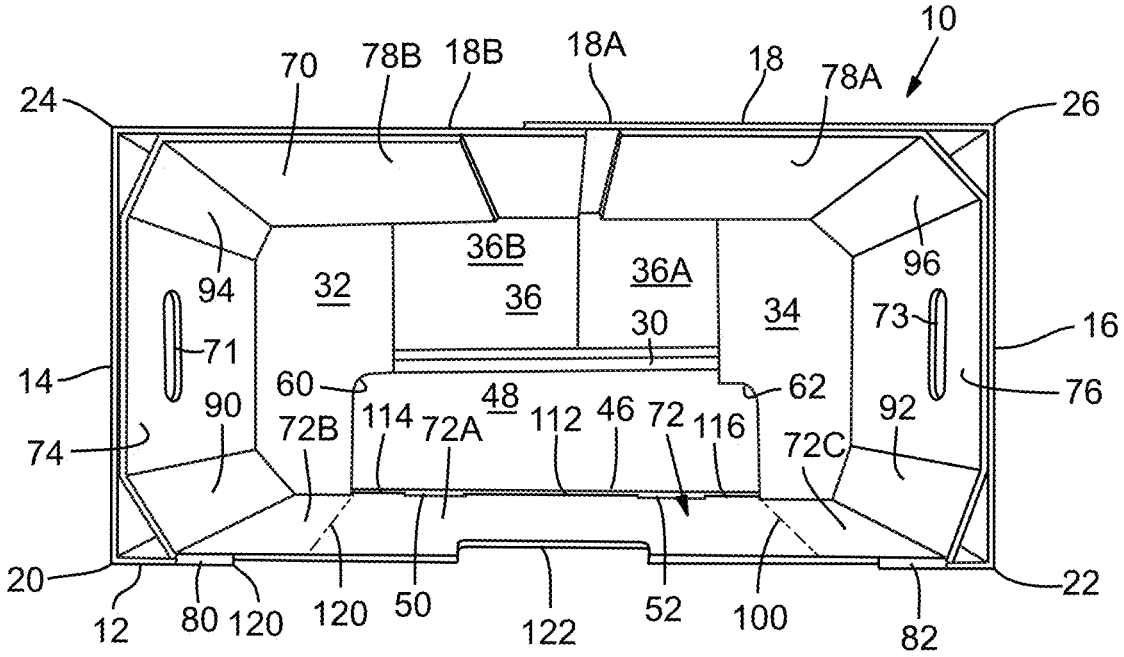
FIG. 2 is a top view of the erected container of FIG. 1.

With reference to FIGS. 1 and 2, the illustrated container comprises a plurality of outer walls formed by outer wall panels that are joined together. More specifically, the exemplary container 10 comprises an outer front wall 12, first and second outer end walls 14, 16 and an outer back wall 18. The illustrated outer front wall 12 comprises a central outer front wall section 13A and first and second outer front wall side sections 13B and 13C on opposite ends of the outer front wall section 13A. The outer front wall 12 includes a display opening 15 bounded by the upper edge of outer front wall section 13A and by the interior side edges of the outer front wall side sections 13B, 13C. The display opening can take any convenient shape, but in FIG. 1 the display opening is shown as U-shaped with concave lower corners. As explained below, the display opening is closed by a detachable or removable interior front wall section 72A that is removed or detached, such as by tearing it way when joined by weakened lines to other portions of an inner front wall panel of the display container when the container is used to display products.

The illustrated outer front wall 12 is joined to outer end wall 14 at a corner 20 defined by a fold line. The outer front wall 12 is also joined to outer end wall 16 at a corner 22 defined by a fold line. Also, the outer end wall 14 is joined to the outer rear wall 18 at a corner 24 defined by a fold line. In addition, the outer end wall 16 is joined to the outer rear wall 18 at a corner 26 defined by another fold line.

In the illustrated example, the outer back wall 18 is formed by a first outer back wall section 18A that has an interior surface that overlaps the exterior surface of a second outer back wall section 18B and that is secured to the second outer back wall section 18B, such as by adhesive, tape, staples or a combination thereof. The outer back wall sections can be interconnected in alternative manners, such as by interlocking tabs.

In the description herein, the term interior refers to a surface facing the interior of the erected container and the term exterior refers to a surface facing the exterior of the erected container.

The outer wall panels 12, 14, 16, and 18 in the illustrated embodiment have respective bottom panel sections 30, 32, 34, and 36 connected, such as by fold lines, to the bottom edges of the respective wall panel sections forming the outer wall panel sections 12, 14, 16, and 18. In the illustrated example, the bottom panel section 36 is formed of a first bottom panel section 36A coupled to back wall section 18A and a second bottom panel section 36B coupled to back wall section 18B. In this example, the interior surface of bottom panel section 36A overlaps and is secured to the exterior surface of the bottom panel section 36B, such as in the same manner as the outer back wall sections 18A and 18B. The bottom panel sections can alternatively be interleaved or otherwise interconnected to form the bottom of the container. However, the illustrated container can be readily erected into a container from the knock down state the bottom panel sections 36A and 36B interconnected as shown by adhesive.

As explained below, desirably the container is formed from a single one-piece blank such as comprising or consisting of paper board with one or more layers of corrugations between paper board sheet material. The container as described herein has a very high vertical stacking strength. Therefore, lighter paper board stock, with a single layer of corrugations (extending vertically in the outer walls and also in the inner walls as described below) can be used, such as C-41o-33M-56, 44 ECT C flute paper board.

The fold lines described above and hereinafter below can be formed in any convenient manner. Desirably, they each can comprise a weakened line, such as formed by creasing or compressing one surface of the corrugated paper board along the desired fold line.

The illustrated outer front wall section 13A comprises a lower centrally positioned front wall panel portion 44 shown in FIG. 1 and a back wall reinforcing panel portion 46 shown in FIG. 2. The interior surface of panel portion 44 faces the exterior surface of reinforcing panel portion 46 to thereby provide a double wall thickness along the bottom edge of the display opening 15. A bottom reinforcing panel portion 48 shown in FIG. 2 extends inwardly from the bottom edge of the back wall reinforcing panel portion 46.

Figure 3:
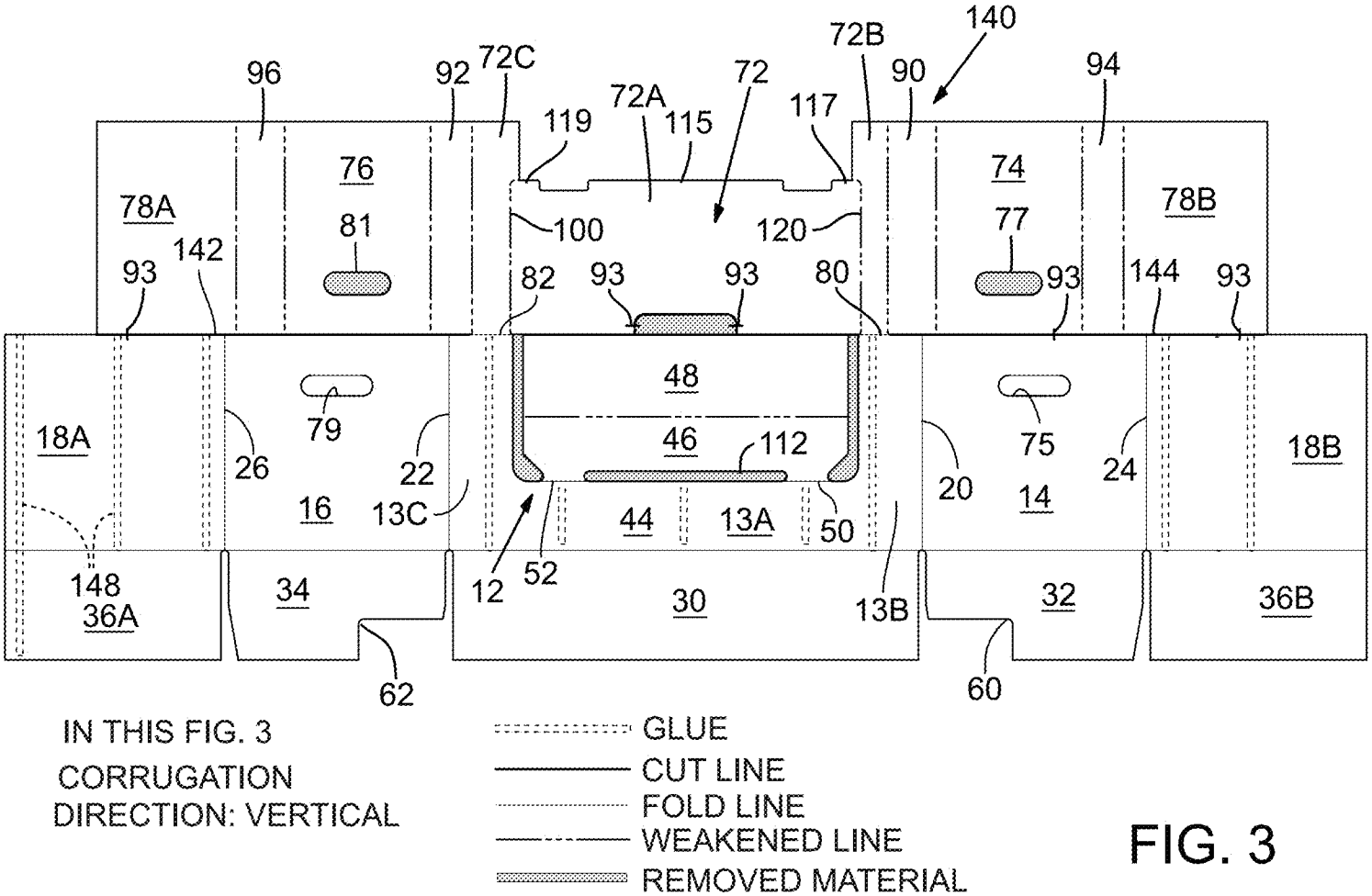
FIG. 3 is a view of a blank that can be used to form the container of FIG. 1, the blank preferably is in one piece.

Panel portion 44 and panel portion 46 are joined together along their top edges by respective spaced apart hinge portions 50, 52 (See also FIG. 3). The hinge portions can have fold lines or weakened lines extending parallel to the respective wall portions 44, 46 to facilitate folding of the panel portions 44, 46 about the hinges 50, 52. The respective bottom panel sections 32, 34 can be provided with notches 60, 62 or cutout regions that provide respective gaps to permit folding of bottom reinforcing panel section 48 against the bottom panel 30.

Thus, in the illustrated embodiment of FIGS. 1-3, the outer wall panel 12 comprises a lower panel section 44 and a central panel portion (panel sections 46 and 48 in this example) pivotally coupled, such as by a fold line 49 (FIG. 5), to the lower panel section 44. The panel section 46 comprises a reinforcing panel portion secured (in the knocked down and erected container) to the interior surface of the outer wall panel lower panel section 44. The term securing in this disclosure refers to connection, such as by adhesive, fasteners (e.g. staples) or a combination thereof with adhesive being the preferred securing approach. The panel section 48 comprises a bottom panel reinforcing panel portion that projects from the reinforcing panel section 46. In the erected and knocked down container, the bottom panel reinforcing panel portion 48 is positioned adjacent to the interior surface of at least one bottom panel portion.

Figure 16:
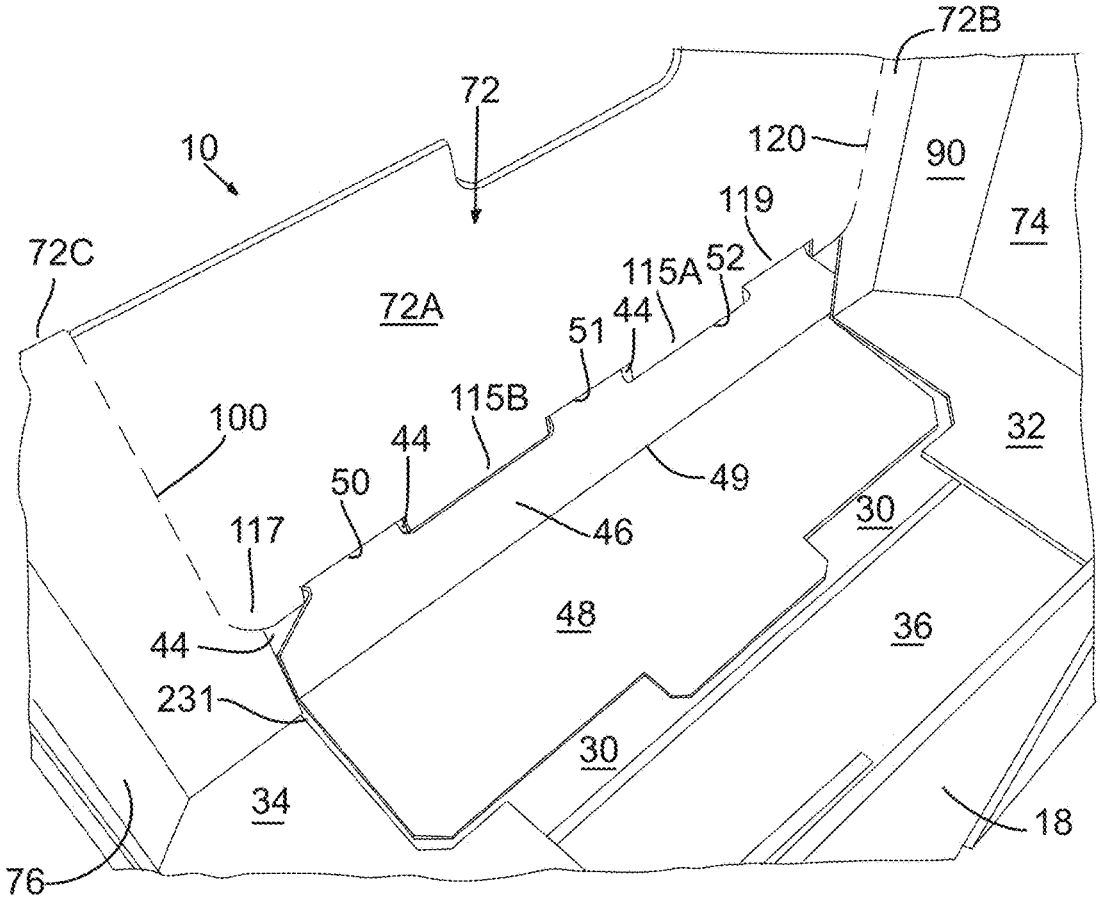
FIG. 16 is a view of the inside of a portion of a display container embodiment with a modified form of a bottom reinforcing panel.
Figure 17:
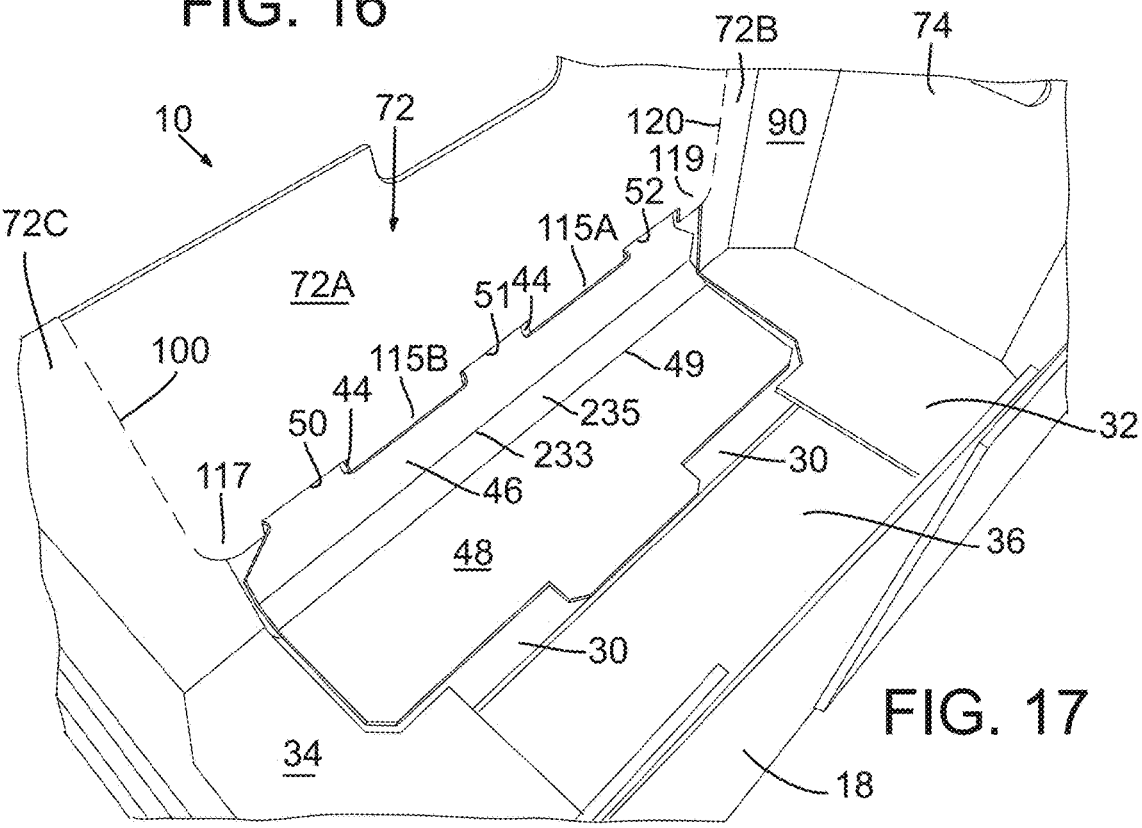
FIG. 17 is a view of the inside of a portion of a display container embodiment with a bottom reinforcing panel.

In the embodiment of FIGS. 1-3, a plurality of bottom panels 30, 32, 34, 36A and 36B are each coupled to a respective one of the lower edges of the first, second, third and fourth outer wall panels. Each of these bottom wall panels comprises an interior surface and an exterior surface. A first of these bottom panels 30 is coupled to the lower edge of a first outer wall panel 12. Desirably, at least a portion, and more desirably a majority or major portion of the exterior surface of bottom panel reinforcing panel portion 48 touches, contacts or abuts an interior surface of the first bottom panel. In the embodiment of FIG. 16, a gap 231 exists or is provided between the bottom panel reinforcing panel portion and the interior surface of the first bottom panel adjacent to the reinforcing panel portion 46. Also, as shown in the embodiment of FIG. 17, the bottom panel reinforcing panel portion 48 can comprise a bottom panel reinforcing panel portion gusset 235, between a fold line 233 and fold line 49 of panel portion 48, the gusset 235 being positioned to span the gap with the gusset 235 spaced from a bottom connection between lower wall panel section 44 and bottom panel 30.

Desirably, the central panel portion overlies the display opening at least in part before pivoting relative to the lower panel section 44 during formation of the display container. The illustrated display opening has first and second side boundaries and, in the blank as should in FIG. 3, central panel portion is positioned between the first and second side boundaries.

In a desirable construction that facilitates the manufacturing of the display container, central panel portion can comprise an upper edge (the edge of panel portion 48 adjacent to the edge of panel section 72A in FIG. 3) that abuts the lower edge of the first inner wall panel (the lower edged of the panel section 72A in FIG. 3) before pivoting the central panel portion (e.g. panel section 46) relative to the lower panel section 44.

The display container also comprises an inner container or liner 70, which can also desirably consist of or comprise corrugated paper board. The inner liner 70 in this example comprises a front liner panel 72, first and second liner end panels 74, 76 and respective first and second liner rear panel sections 78A and 78B (See, for example, FIG. 2). The exterior surfaces of the respective liner panels 74, 76 and 78A, 78B face the respective interior surfaces of outer end walls 14, 16 and outer back wall sections 18A and 18B. In addition, the front inner front liner panel 72 has a central portion 72A that closes the display opening 15 and side portions 72B and 72C with exterior surfaces that face the interior surfaces of the respective front outer wall panel sections 13B and 13C. Desirably the liner panels 74, 76, 78A, 78B, 72B and 72C extend from the upper surface of the bottom of the container to the top edges of the adjacent outer walls to improve the vertical stacking strength of the display container. The stacking strength is also improved by desirably providing the liner wall panels of paper board with vertically extending corrugations (corrugations that extend in the top to bottom directions along the liner panels). The adjacent edges of liner panel section 72A and bottom reinforcing panel section 48 desirably meet or abut one another as shown in FIG. 3. Although not required, this makes the display container easier to manufacture.

The inner container or reinforcing liner 70 is desirably coupled to the outer container panels such that the entire container can be formed of a unitary one-piece blank. One or more hinge portions can interconnect the inner container or reinforcing container with the outer container. Desirably, at least one hinge is provided to couple the upper edge of the first outer wall panel to the upper edge of the first inner wall panel and wherein the at least one hinge is pivotal about a hinge pivot axis. The hinge pivot axis can be positioned such that the first, second and third inner wall panels and first and second gussets are pivotal about the hinge pivot axis to position the exterior surfaces of the first, second and third inner wall panels in a position facing the respective interior surfaces of the first, second and third outer wall panels. The at least one hinge can comprise first and second spaced apart hinges that each are pivotal about the hinge pivot axis. Also, a portion of the display opening is desirably positioned between the first and second hinges. In addition, in the erected display container, the first and second hinges can be the only connection between: (i) the top edges of the respective first and second gussets, the respective top edges of the first, second and third outer wall panels: and (ii) the respective top edges of the first, second and third inner wall panels.

Although additional hinges can be used, in the illustrated example of FIGS. 1-3, a first hinge 80 couples the upper edge of the liner panel section 72B to an upper edge of the outer wall panel section 13B. In addition, a second hinge 82 the upper edge of the liner panel section 72C to an upper edge of the outer wall panel section 13C. These hinges 80, 82 are more apparent in the blank shown in FIG. 3. Thus, in the illustrated example, hinge 80 is spaced from but adjacent to, corner 20. In addition, hinge 82 is spaced from but adjacent to, corner 22. In the embodiment of FIG. 3, hinge 82 is positioned inwardly of corner gussets 92, 96 and hinge 80 is positioned inwardly of corner gussets 90, 94; such gussets being explained below.

It is also possible for the hinges 80, 82 to be located at the corners of the container as an alternative. However, the illustrated construction allows reinforcing liner gussets to be provided in the display container. That is, a first gusset 90 extends between inner liner panel section 72B and inner wall liner end panel 74, a second gusset 92 extends between inner wall liner panel section 72C and inner end wall liner panel 76. A third gusset 94 extends between inner wall liner panel 74 and inner rear wall panel section 78B. Also, a fourth gusset 96 extends between inner wall liner 76 and the back inner wall liner panel section 78. These gussets further reinforce the corners of the display containers. The angles between the gussets and outer walls are desirably acute and more desirably between about 30 degrees and 45 degrees. In addition, desirably the gussets have corrugations that extend from the top to bottom directions to further enhance the stacking strength of the container.

The gussets can be formed by providing fold lines where they intersect the respective inner liner wall panels. Alternatively, they may be provided with weakened areas, such as perforations, slits and the like at the location where the gussets joint the respective liner wall panels.

The panel liner wall sections 72B, 72C are desirably glued or otherwise secured to the adjacent respective outer front wall sections 13B and 13C. In addition, the panel sections 78A and 78B are desirably glued or otherwise secured to the respective outer rear wall panel sections 18A and 18B. In addition, the inner end wall liner panels sections 74 and 76 desirably float relative to the adjacent outer walls 14, 16. That is, they are desirably not secured to the outer walls 14, 16. In addition, the gussets are also desirably not secured to the outer walls. This construction allows the relative movement between the liner end wall panels 74, 76 and the outer walls of the container and also the relative movement between the gussets and outer walls of the container. As a result, the container can be folded from a knock down state to the erected container with the gussets moving to positions spaced apart from the adjacent outer walls.

The respective adjacent outer walls and inner liner panels 14, 74 and 16, 76 can be provided with handhold openings that end up aligned to form respective container handholds 71, 73 (FIG. 2) when the container is erected. Desirably at least the material forming the outer handhold openings remains attached to the outer end walls during shipment to seal the ends of the container. The hand hold forming openings can be defined by weakened boundaries, such as perforations, slits or the like. In addition, the upper end of the handhold opening forming material in the outer end walls can be attached to the end wall along a fold line such that the outer end wall handhold forming opening material can be pushed inwardly to open the handhold and reinforce the upper edge of the now open handhold opening. An exemplary pair of handhold openings or handhold forming weakened areas in outer end wall 14 and liner end wall panel 74 that end up aligned to form the handhold 71 when the container is erected, and the handhold is opened are indicated at 75 and 77 in FIG. 3. An exemplary pair of handhold openings or handhold forming weakened areas in outer end wall 16 and liner end wall panel 76 that end up aligned to form the handhold 73 when the container is erected, and the handhold is opened are indicated at 79 and 81 in FIG. 3.

With the construction shown in FIGS. 1 and 2, the corners are reinforced by the illustrated gussets. In addition, the end walls have vertically extending dual layers 14, 74 and 16, 76 which further reinforce the box and provide enhanced stacking strength. Moreover, a major portion of the back wall of the container also comprises multiple layers of paperboard material with vertically extending flutes or corrugations. Desirably at least one-half to three-fourths, and more desirably more than three-fourths, such as at least ninety percent, of the back wall comprises a plurality of layers of paperboard material with vertically extending flutes or corrugations The panel section 72A is desirably provided with weakened areas along edges 100, 120 of the panel section 72 that are desirably aligned with the side edges of the display container opening 15. The bottom edge of liner panel section 72A has a central tab 115 and side tabs 117, 119 (FIG. 3) positioned for engaging the interior surface of outer panel section 44 along respective slots 112, 114 and 116 formed in the fold between the outer wall panel section 44 and inner reinforcing panel section 46 and holds the bottom of the liner panel section 72A in place and resists outward bulging of the panel section 72A. The hinge 50 (FIG. 1) is positioned between the tabs 115, 117 and the hinge 52 is positioned between the tabs 115 and 119. In the illustrated construction, the tab 115 is wider than the tabs 117 and 119. Consequently, the liner panel section 72A is held in place during shipment but can readily be removed by, in this embodiment, tearing it away, to expose the display container opening 15 when the container is used to display product contained therein. Other approaches can be used for detachably holding the liner panel section 72A in place. The tabs can be lengthened or shortened.

The display containers can be stacked on top one another. Also, a cutout 122 along the upper edged of the liner panel section 72A can readily be gripped by a user and pulled to separate panel section 72A from the container to open the front of the container for display purposes. The container can also be used as a shipping container. When used as a shipping container, a cover or lid can be used. One exemplary form of lid or cover is a half-slotted container lid of a conventional construction. The illustrated container can be formed in one pass through a box folding machine from a unified one-piece blank. In addition, waste material is minimized as the container is substantially formed from a rectangular blank with minor portions of the blank removed by cutting.

FIG. 3 illustrates an exemplary blank 140 for use in forming the container of FIGS. 1 and 2. The respective outer walls and liner panel section, and other elements discussed above in connection with FIGS. 1 and 2 have been assigned the same numbers in the two-dimensional (not counting the thickness) blank of FIG. 3. In addition, exemplary glue lines are also shown in FIG. 3 (two of which are numbered as 148. In this construction, a single type of glue can be used, although multiple types of glue can be used if desired. For example, cold setting glue can be used.

It should be noted that cut lines are shown by heavier lines in FIG. 3. However, this is an exaggeration, as the cut lines are simply slits that extend through the container blank. As an example, a cut line 142 can extend between the liner wall panel section 78A, gusset 96, liner wall panel 76 and gusset 92 and the adjacent upper edge forming portions of the outer walls 18A, 16 and 13C, stopping at the hinge 82. In a similar manner, a cut line 144 can extend between the liner wall panel section 78B, gusset 94, liner panel wall 74 and gusset 90 and the adjacent upper edge forming portions of the outer walls 18B, 14 and 13B, stopping at the hinge 80. In addition, as is conventional, nicks can be provided in the respective wall sections along the cut lines as desired to temporarily hold the panel sections together as they are fed through a box folding machine. During folding, these nicks end up separated. In FIG. 3, exemplary nicks 93 are shown to temporarily join panel sections 78A and 18A; 74 and 14; and 78B and 18B. For convenience, nicks, if included, are not shown in other FIGS.

In FIGS. 4-7, not all of the glue lines, fold lines, weakened lines and cut lines shown in the blank of FIG. 3 are indicated in these FIGS. However, FIGS. 4-7 are provided to illustrate an assembly sequence by which a blank 140 can be formed into a knocked down version of the container of FIG. 1 in a single pass through a box forming machine.

Figure 4:
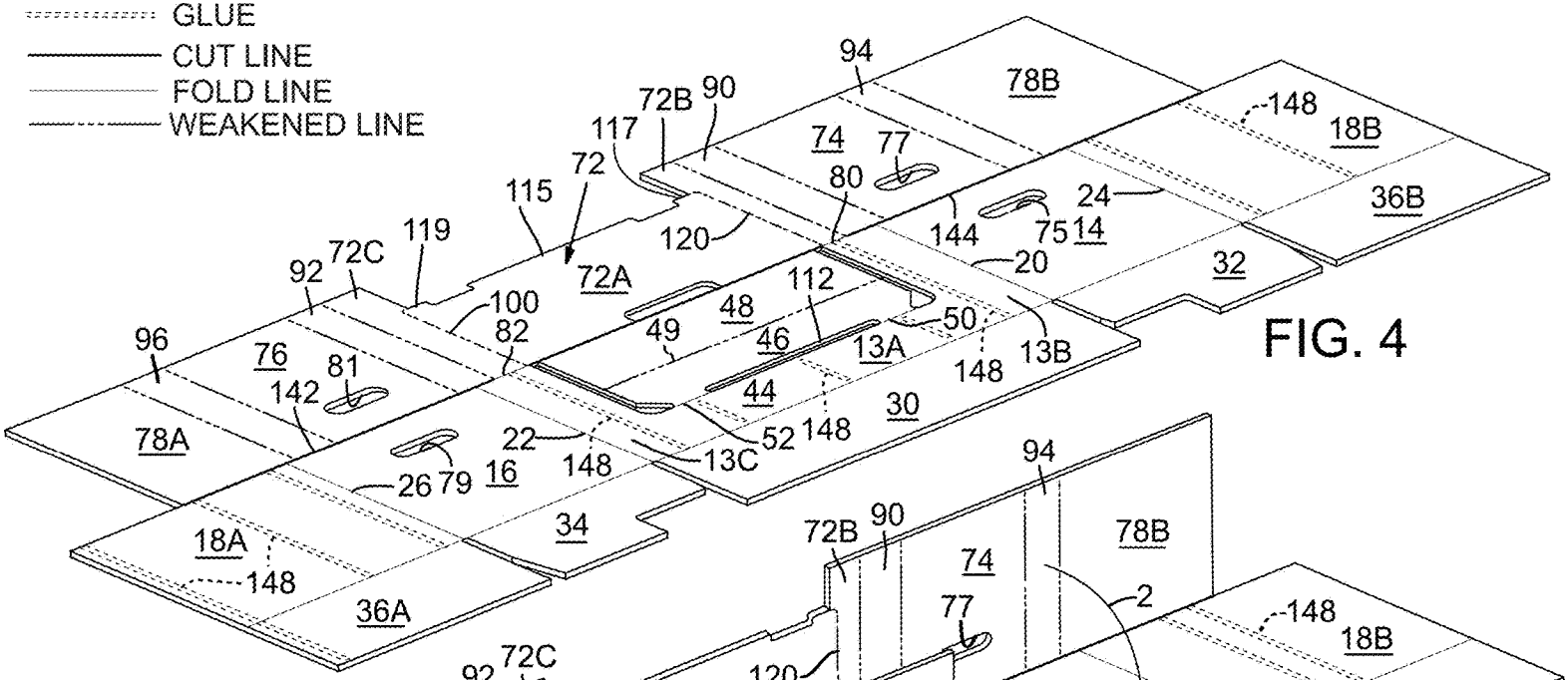
FIGS. 4-7 illustrate views of the blank being folded through successive steps to form a knock down version of a blank which then can be erected into the container of FIG. 1.
Figure 5:
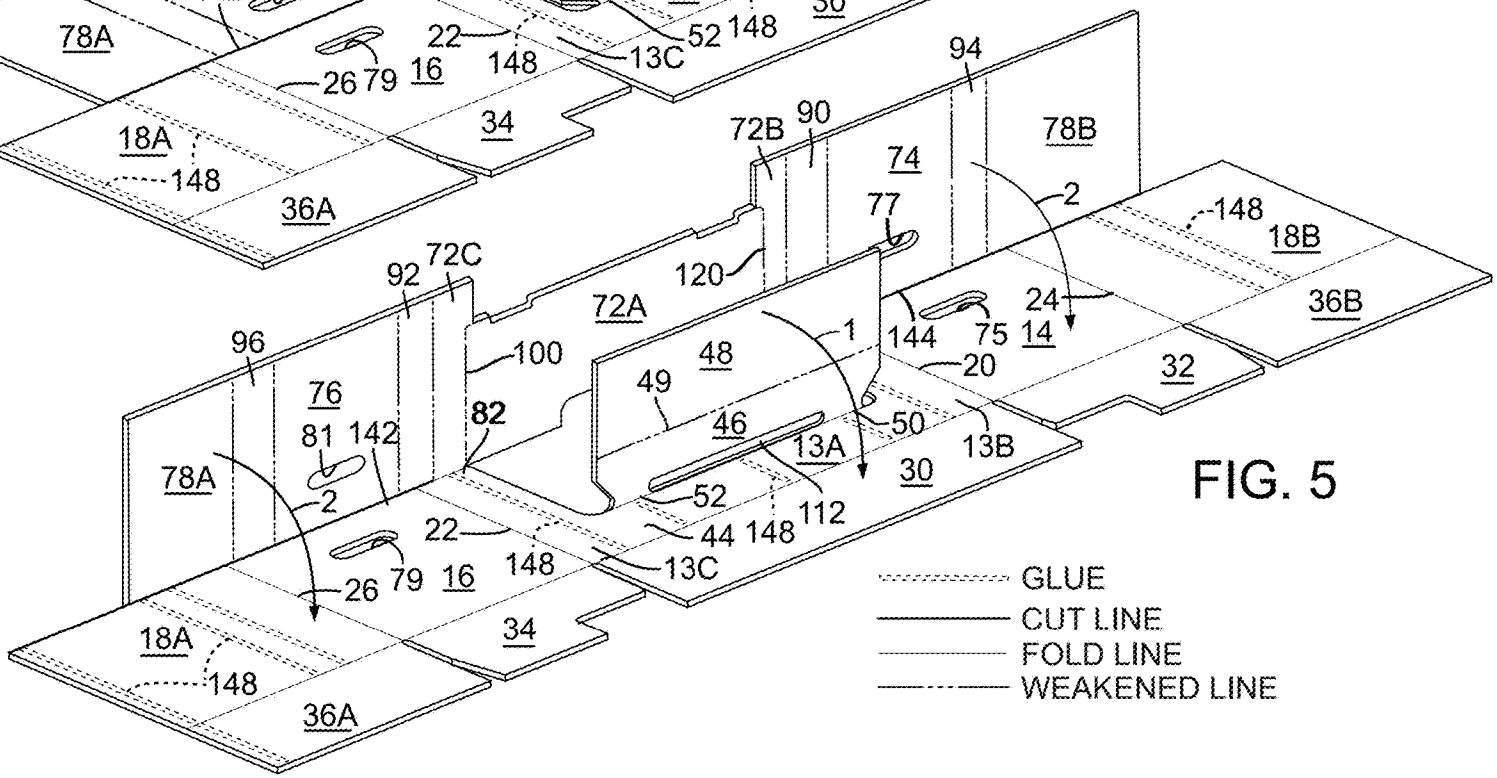
Figure 6:
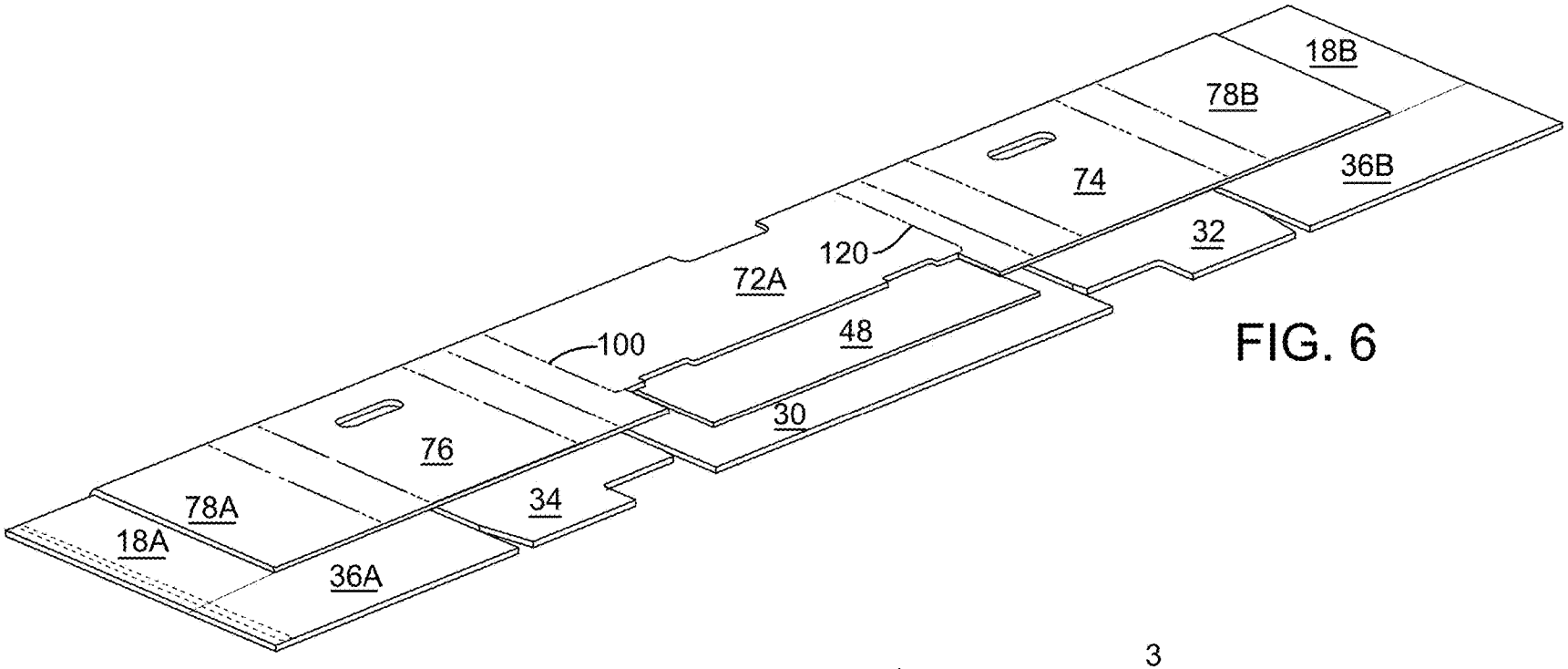

Referring to FIG. 4, an exemplary blank such as shown in FIG. 3 is provided with the exterior surfaces of the outside walls facing down. In an exemplary box forming approach, in a first folding step shown with reference to FIG. 5, the panel comprising panel sections 46 and 48 is pushed up and folded over (Step 1) to place panel section 48 against bottom panel section 30 and panel section 46 against panel section 44. Panel section 44 is glued, in this example, to the panel section 46 to form a reinforced front wall panel section 13A (FIG. 1). As can be seen in FIGS. 5 and 6, the liner panels comprising the gussets and liner wall panels 78A, 76, 72, 74 and 78B are pushed up as a unit and folded over about hinges 80, 82 (only hinge 82 being visible in FIG. 5) against the interior surfaces of the respective outer wall panels 18A, 16, 12, 14 and 18B as shown in FIG. 6 (Step 2). Referring to the glue lines in FIG. 3, in this step, liner wall panel 78A is glued to the interior surface of outer back wall section 18A, liner panel section 72B is glued to the interior surface of outer wall section 13B, liner panel section 72C is glued to the interior surface of outer wall section 13C, and liner panel section 78B is glued to the interior surface of outer back wall section 18B.

Figure 7:
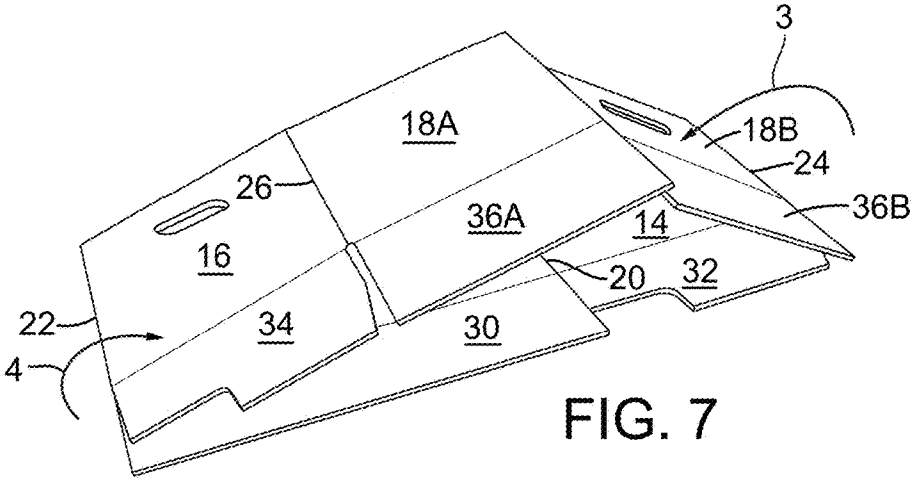

The end result after Steps 1 and 2 is a flattened partially assembled container as shown in FIG. 6. With reference to FIG. 7, The outer end wall section 18B and attached liner panel section 78B are folded about the fold line at corner 24 (Step 3) and the outer wall panel 16 and outer rear wall section 18A are folded about the fold line at corner 22. The outer most glue line at the left side of FIG. 3 glues the interior surface of the outer rear wall section 18A to the exterior surface of the outer rear wall panel section 18B (Step 4) to provide the knocked down container; which is the flattened version of the partially assembled container of FIG. 7. In this flattened state, the outer container walls and bottom forming panels are in two substantially parallel planes with the liner wall panels and gussets in two substantially parallel planes between the outer container walls.

It should be understood that other sequences of steps can be used to assemble the knock down container from the box blank. However, the above described sequence is advantageous as it facilitates assembly as the blank is passed in one direction in one pass through a box forming machine. The glue lines can be applied in a gluing station upstream from the box folding portions of the box assembly machine.

Figure 8:
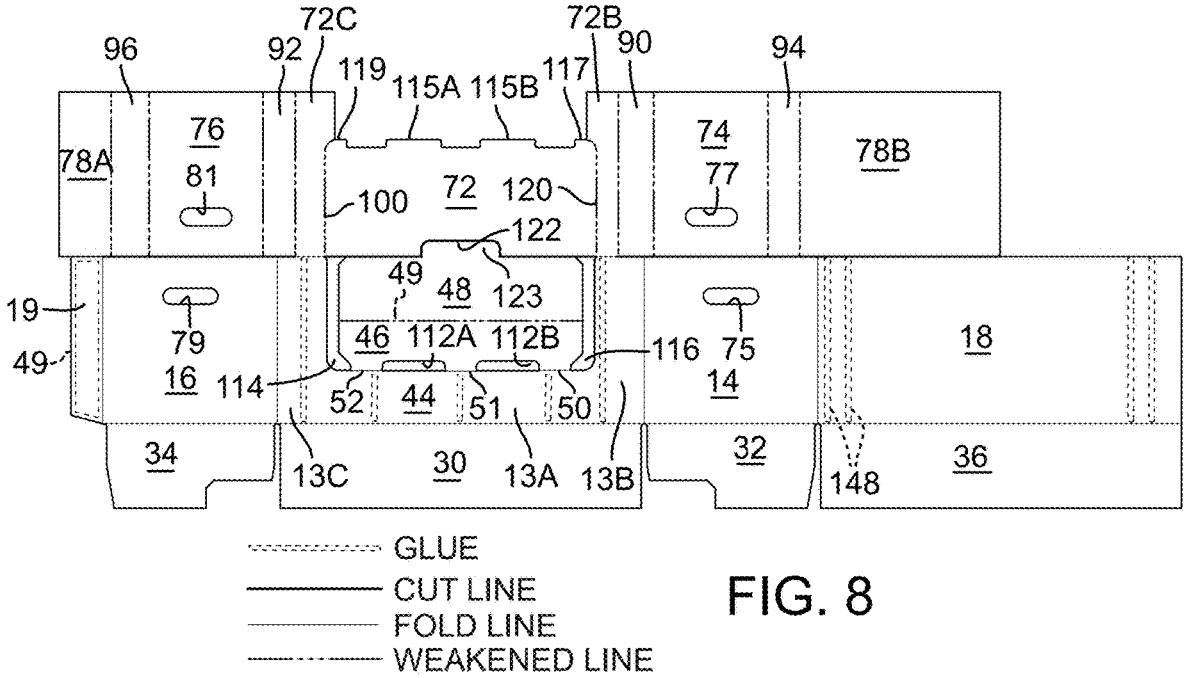
FIG. 8 is a plan view of a blank for a second embodiment of a display container.
Figure 9:
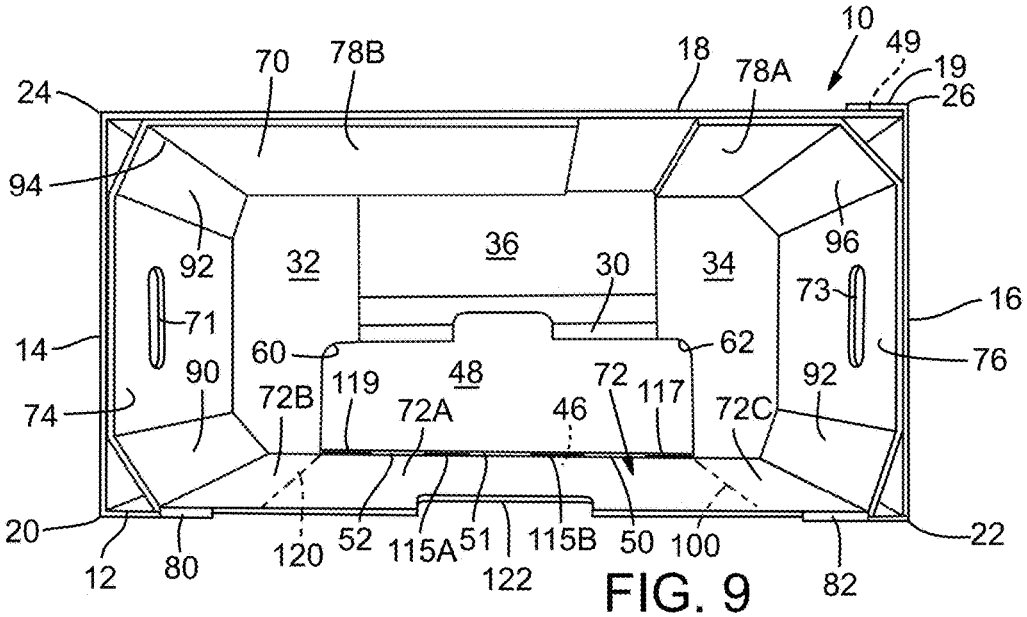
FIG. 9 is a top view of the erected container of FIG. 8.
Figure 10:
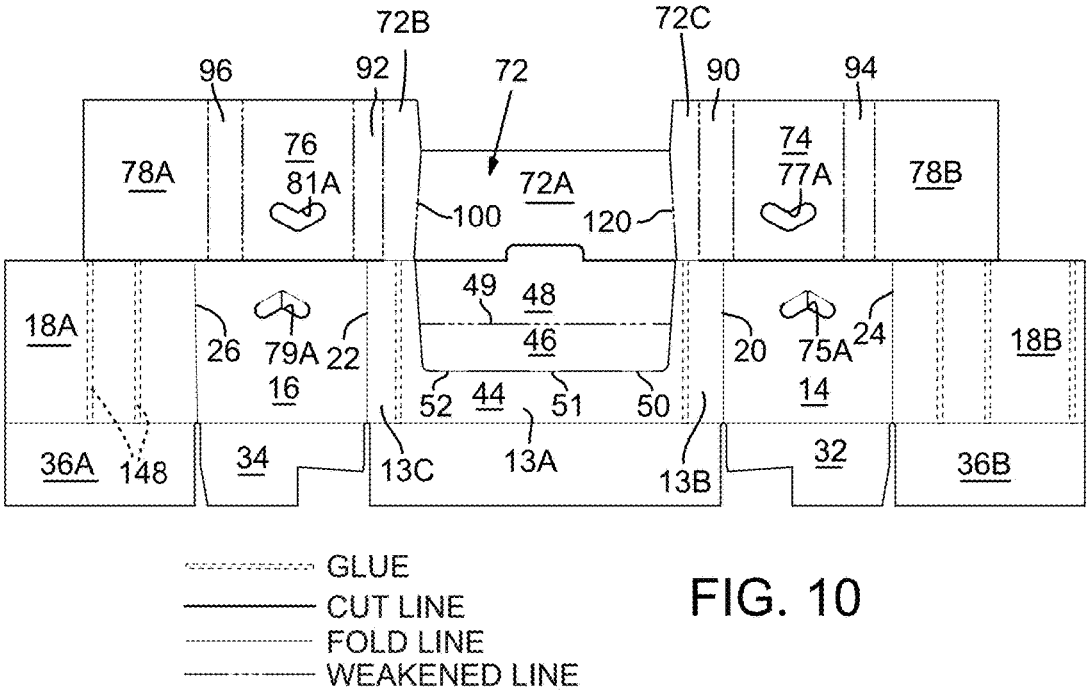
FIG. 10 is a plan view of a blank for a third embodiment of a display container.

FIGS. 8-10 illustrate two additional embodiments of display containers in accordance with this disclosure. In FIGS. 8-10 the same numbers have been assigned to corresponding components as found in the FIGS. 1-7 embodiment. The description focuses on the differences in the FIGS. 8-10 embodiments from the FIGS. 1-7 embodiment.

In the embodiment of FIG. 8, the bottom edge of liner panel section 72A, instead of having one central tab 115, has two central tabs 115A and 115B with a gap therebetween. In addition, rather than having a single centrally positioned tab receiving slot 112, the FIG. 8 embodiment has two spaced apart receiving slots 112A and 112B positioned to receive the tabs 115A and 115B, respectively. When the panel 72 is folded, the central tabs 115A and 115B and side tabs 117, 119 (FIG. 8) are positioned for insertion into respective slots 112A, 112B, 116 and 114 formed in the fold between the outer wall panel section 44 and inner reinforcing panel section 46. The hinge 50 (FIG. 8) is positioned between the tabs 115B and 117; the hinge 52 is positioned between the tabs 115A and 119; and a hinge 51 is positioned between the tabs 115A and 115B.

In addition, in the embodiment of FIG. 8, a glue tab panel is coupled by a fold line to the outer edge of the outer wall panel section 16. Adhesive 49 can be applied to the interior surface of the glue tab panel 19 (the undersurface of the glue tab panel shown in FIG. 8. When assembled, as shown in FIG. 9, the glue tab panel 19 overlies a portion of the exterior surface of the outer wall panel 18 and secures the outer wall panels together. Staples or other fasteners can be used instead of adhesive if desired.

As can also be seen in FIG. 9, the portion 123 along the cutline 122 of panel section 72A can be left attached to panel section 48. The portion 123 is positioned against bottom panel section 30 (and it can be sized to span any gap between bottom panel sections 30, 36B if these bottom panel sections are not sized to overlap, as can be done) when the display container is erected.

In the design of FIG. 3, the inner panel sections 70A and 70B can have the same length. In the embodiment of FIGS. 8 and 9, the inner support panels are of different lengths (inner support panel 78B being longer than inner support panel 78A in this example). For example, support or liner panel section 78B can be at least twice as long as panel section 78A, and more desirably at least three times as long.

In the embodiment of FIG. 10, the removable or tear away panel section 72A is shown as trapezoidal and illustrates that the removable panel can be of different configurations. The tear away panel section 72A of this embodiment has angled sides. In addition, the handholds 75A, 77A, 79A and 81A are shown as angled handholds, somewhat V-shaped, and illustrates another handhold style option for display containers with handholds. Also, in the FIG. 10 embodiment. The outer or distal edge of the removable panel section 72A lacks insertion tabs and the edge between panel sections 46 and 48 is shown without tab receiving or offset relief slots. In this example the tear away panel section 72A is connected by a weakened connection at side edges 100, 120 to the respective adjacent panel sections 72C and 72B.

Figure 11:
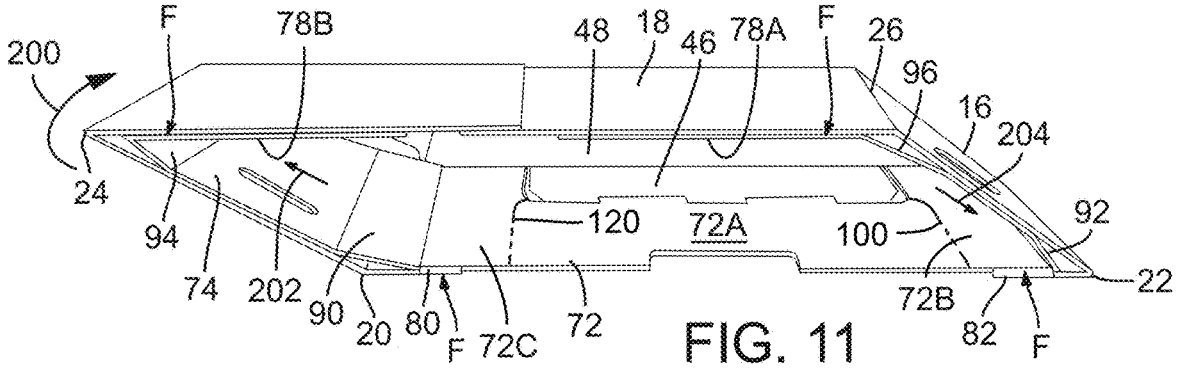
FIGS. 11-13 illustrate the erection of display containers in accordance with this disclosure from a knockdown state to an erected state.
Figure 12:
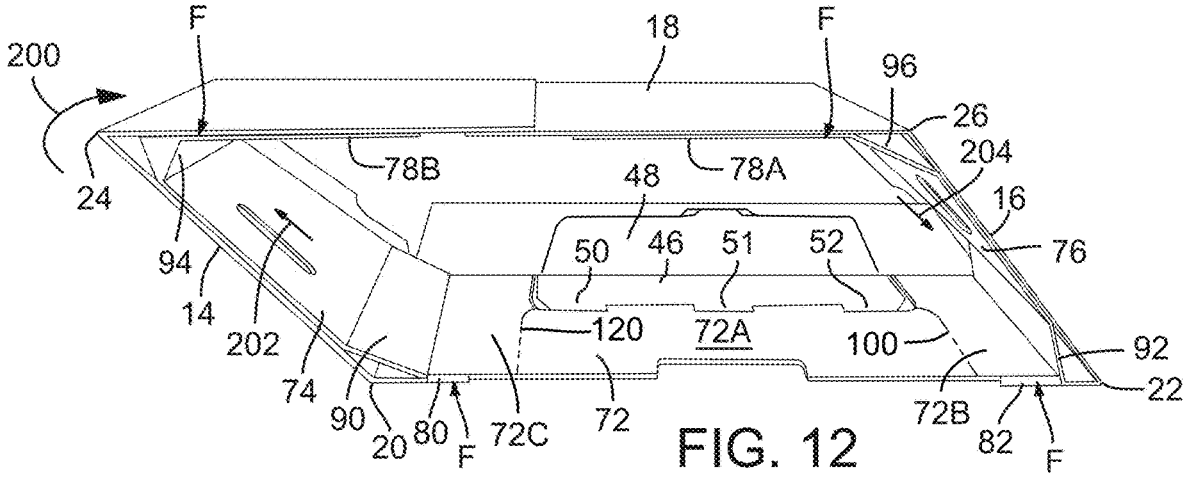
Figure 13:
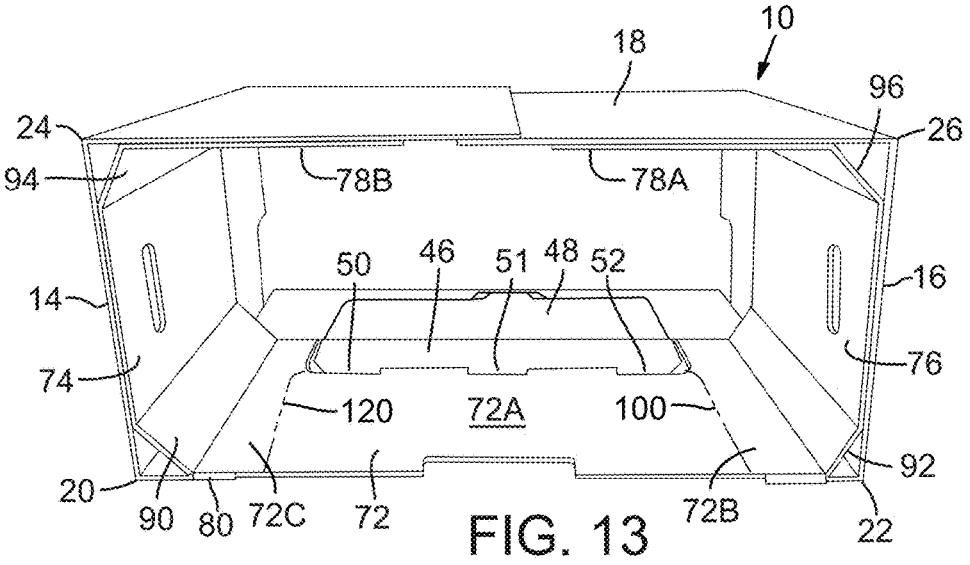

FIGS. 11-13 describe an erection sequence that can be used for all of the embodiments; including both the center glue or corner glue seam style display containers. The display containers can be hand or machine erected.

The embodiments as described above desirably have an even layer built up structure that allows for stable bundling of multiple display containers when shipped flat in a knock down state to customers. This construction facilitates shipping, handling and feeding into automatic container erection machines if machine erection is being employed.

FIGS. 11-13 illustrate the erection of the display container from a partially erected state (FIG. 11), to a more advanced erected state (FIG. 12) and to a substantially complete erected state (FIG. 13). When the bottom panel sections are folded into position, the container is fully erected. In FIGS. 11 and 12, the letter F indicates some of the locations where adjacent surfaces of exterior wall panel sections and interior support or liner panel sections are secured together (e.g. along glue lines). In contrast, the support or liner panel section 74 and the gussets 90, 94 can move or float between the fixed connection locations and relative to adjacent surfaces of the outer wall panel sections. In addition, the support or liner panel section 76 and the gussets 92, 96 can move or float relative to the adjoining surfaces of the outer wall panel sections. Therefore, when adjacent outer wall sections are racked relative to one another as indicated by arrow 200 in FIG. 11, the floating wall panel 74 and floating wall panel 76 can move as indicated by respective arrows 202, 204 with the respective gussets moving away from their respective adjacent container corners. This is also illustrated in the further erected state of the display container as shown in FIGS. 12 and 13.

Figure 14:
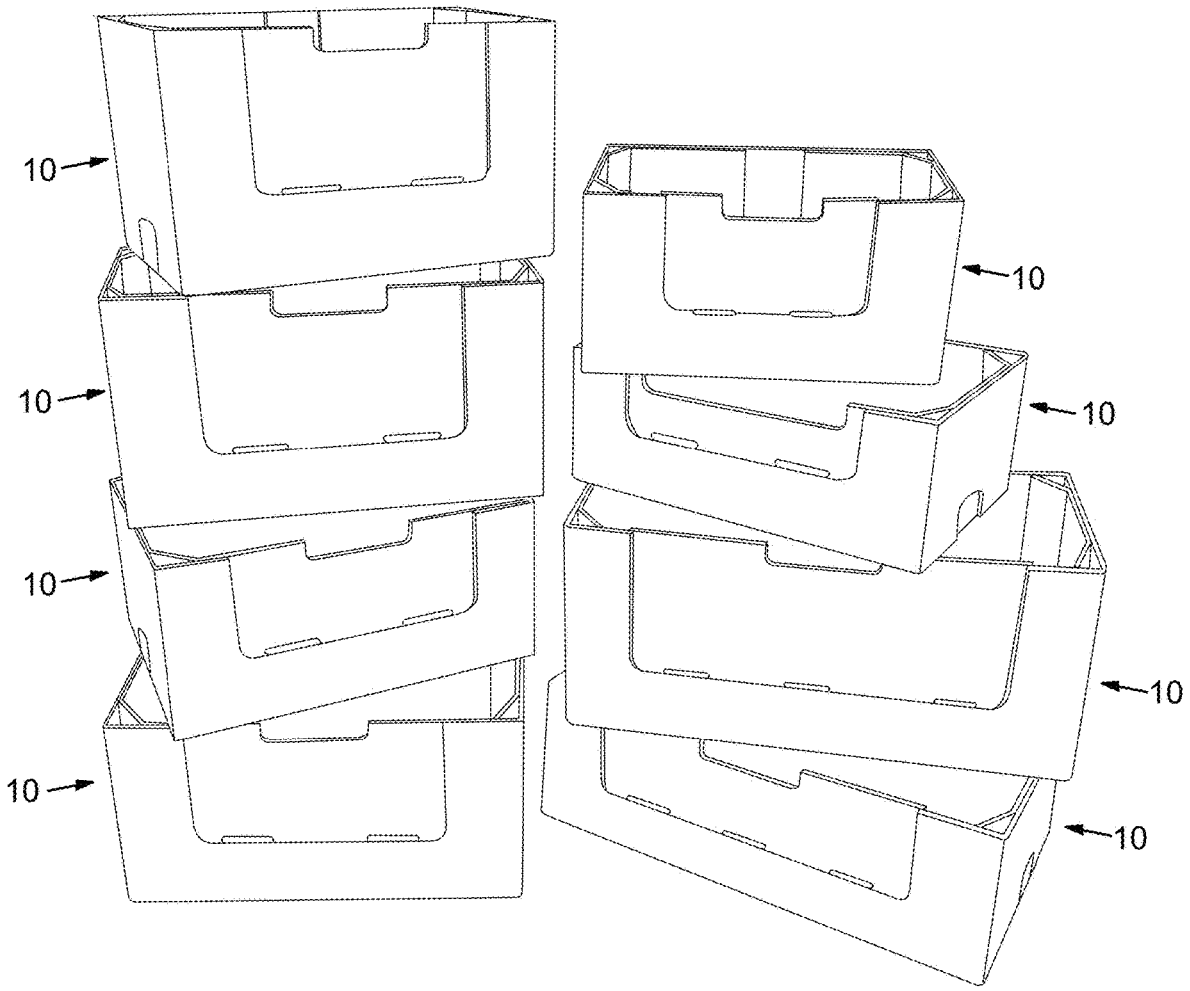
FIG. 14 is a view of a stack of containers of various dimensions provided to illustrate the versatility of the display container design.

FIG. 14 shows a plurality of erected display containers 10 in accordance with this disclosure and illustrates the variations in container height, length and widths that can be achieved in containers constructed in accordance with this disclosure.

Figure 15:
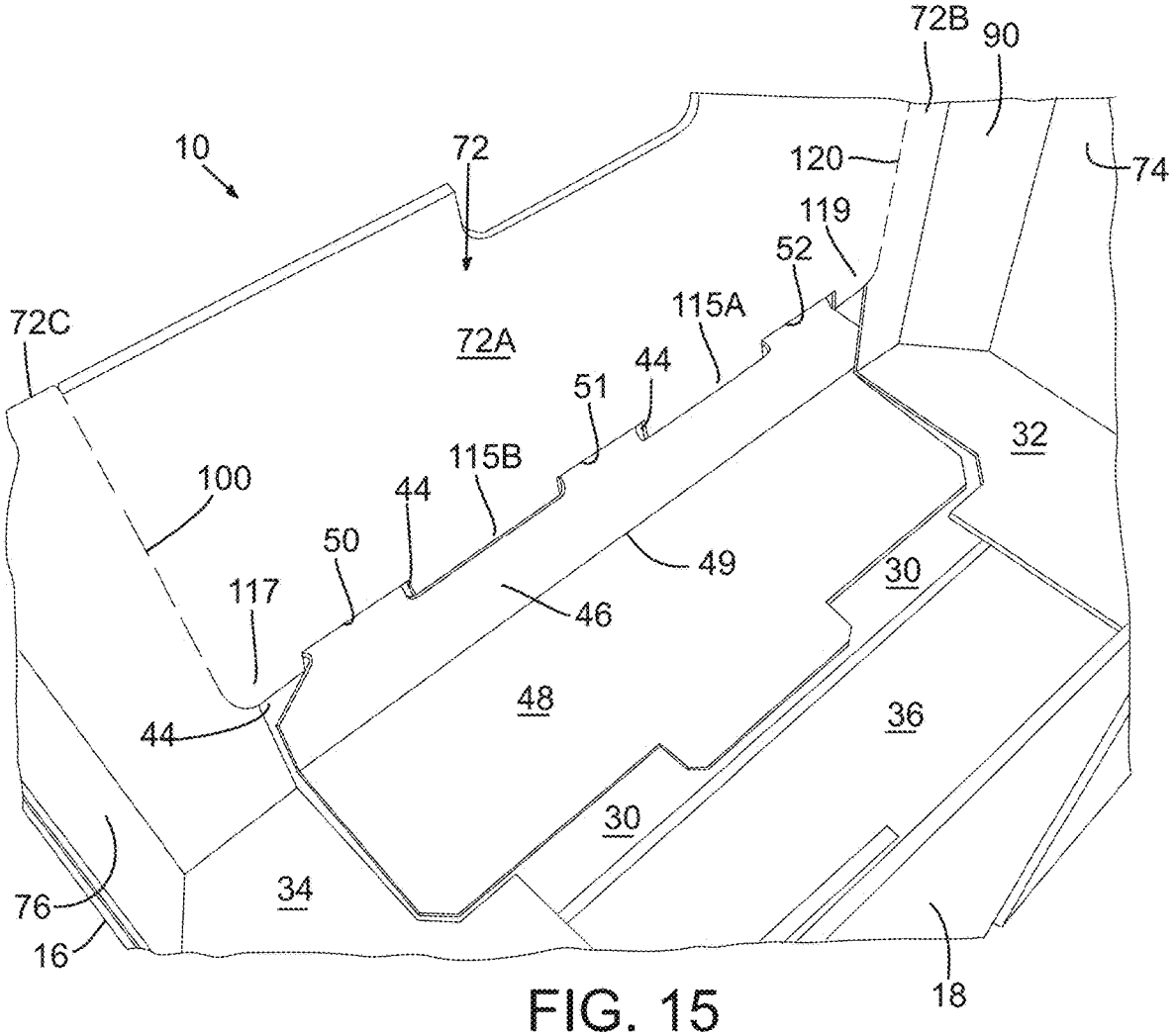
FIG. 15 is a view of the inside of a portion of the display container of FIG. 9 prior to removing a tear away or removable display opening covering panel portion.

FIG. 15 illustrates a portion of the front display container wall of the embodiment of FIG. 10 (it being understood that the embodiment of FIGS. 1 and 2 is similar but has a single tab 115 instead of the two tabs 115A and 115B of FIG. 10.

The bottom edge of the removable panel section 72A has a central tab 115 and side tabs 117, 119 (FIG. 3) positioned for engaging the interior surface of one or both of the interior surface of reinforcing panel section 46 or the lower wall panel section 44. This connection resists product in the display container from pushing the removable panel section outwardly from the display container before it is removed when desired. The above feature is also desirably included in the embodiment of FIG. 10 except in FIG. 10, the lower edge of the removable panel section would overlap the upper edge of the panel section 46, at least in part. Desirably at least one central panel hinge (in FIG. 15 there are a plurality of such hinges, namely hinges 50, 51 and 52) pivotally couples the central panel portion (in this example central panel section 46) to the upper edge of the outer wall panel lower section 44. In a desired example, the lower edge portion of the detachable panel section can desirably be provided with gap at the location of the at least one hinge (and at each hinge if more than one is provided). The gaps (e.g. between tabs 119 and 115A, 115A and 115B, and 115B and 117) are positioned and sized such that the exterior surface of the lower edge of the removable panel section does not abut the hinge. Instead, an interior surface of the upper edge portion of the lower panel section 44 abuts the exterior surface of the tabs. As a result, an additional overlapping layer of container material is eliminated at this location.

The display container wall of FIG. 15 can comprise a reinforcing panel portion 46 with an upper edge and the outer wall panel lower panel section 44 can comprise an upper edge portion that has an interior surface extending above the upper edge of the of the reinforcing panel portion 46. In addition, the exterior surface of a lower edge portion of the detachable panel section can abut at least a portion of the interior surface of the upper edge portion of the outer wall panel lower panel section 44 prior to removal of the detachable panel section.

In the embodiment of FIG. 15, the detachable panel section has first side edge coupled by a weakened line to a first inner wall side section 72B and a second side edge coupled by a weakened line to a second inner wall side section 72C, and wherein the detachable panel section has a lower edge portion exterior surface that abuts at least a portion of the interior surface of the outer wall panel lower panel section.

The embodiment of FIG. 16 is like the embodiment of FIG. 15, except that a gap 231 is provided between the exterior surface of the bottom panel reinforcing panel portion 48 and the bottom panel 30 adjacent to the panel section 46. The embodiment of FIG. 17 includes a gusset 235 spanning this gap.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

The invention claimed is:

1. A display container comprising:

first, second and third outer wall panels, each with respective exterior and interior wall panel surfaces and upper and lower wall panel edges;

the first outer wall panel defining a display opening;

the second outer wall panel being coupled to the first outer wall panel at a first corner and the second outer wall panel being coupled to the third outer wall panel at a second corner;

first, second and third inner wall panels each with a respective exterior and interior wall surface, an upper edge, a lower edge, and first and second opposed side edges;

the first inner wall panel comprising a detachable wall panel section that overlays the display opening and that, when the detachable wall panel section is removed, opens the display opening;

wherein the exterior surface of the first inner wall panel faces and is secured to the interior surface of the first outer wall panel, the exterior surface of the second inner wall panel faces and is not secured to the interior surface of the second outer wall panel, and the exterior surface of the third inner wall panel faces and is secured to the interior surface of the third outer wall panel;

a first gusset comprising a first gusset top edge and first gusset first and second side edges, wherein the first gusset first side edge is pivoted to the first side edge of the first inner wall panel and the first gusset second side edge is pivoted to the first side edge of the second inner wall panel;

a second gusset comprising a second gusset top edge and second gusset first and second side edges, wherein the second gusset first side edge is pivoted to the first side edge of the third inner wall panel and the second gusset second side edge is pivoted to the second side edge of the second inner wall panel; and at least one hinge coupling the upper edge of the first outer wall panel to the upper edge of the first inner wall panel and wherein the at least one hinge is pivotal about a hinge pivot axis, wherein the first, second and third inner wall panels and first and second gussets are pivotal about the hinge pivot axis to position the exterior surfaces of the first, second and third inner wall panels in a position facing the respective interior surfaces of the first, second and third outer wall panels.

2. A display container according to claim 1 wherein the at least one hinge comprises first and second spaced apart hinges that each are pivotal about the hinge pivot axis.

3. A display container according to claim 2 wherein a portion of the display opening is positioned between the first and second hinges.

4. A display container according to claim 2 wherein the first and second hinges are the only connection between: (i) the respective top edges of the first and second gussets, the respective top edges of the first, second and third outer wall panels: and (ii) the respective top edges of the first, second and third inner wall panels, the first and second hinges providing the hinge pivot axis about which the inner and outer wall panels are foldable during erection of the display container.

5. A display container according to claim 1 comprising a plurality of bottom panels each coupled to a respective one of the lower edges of the first, second, third and fourth outer wall panels and wherein each bottom panel comprises an interior surface and an exterior surface.

6. A display container according to claim 5 wherein a first bottom panel of the bottom panels is coupled to the lower edge of the first outer wall panel, and wherein the first outer wall panel comprises a lower panel section and a central panel portion coupled by a fold line to the lower panel section, the central panel portion comprising a reinforcing panel section secured to the interior surface of the first outer wall panel lower panel section and a bottom panel reinforcing panel portion projecting from the reinforcing panel section and positioned adjacent to the interior surface of the first bottom panel portion.

7. A display container according to claim 6 wherein at least a portion of the bottom panel reinforcing panel portion touches an interior surface of the first bottom panel.

8. A display container according to claim 7 wherein the bottom panel reinforcing panel portion has an exterior surface that abuts the interior surface of at least the first bottom panel.

9. A display container according to claim 7 wherein a gap exists between the bottom panel reinforcing panel portion and the interior surface of the first bottom panel adjacent to the reinforcing panel portion.

10. A display container according to claim 9 wherein the bottom panel reinforcing panel portion comprises a bottom panel reinforcing panel portion gusset positioned to span the gap.

11. A display container according to claim 1 wherein the first outer wall panel comprises a lower panel section and a central panel portion pivotally coupled to the lower panel section, the central panel portion overlying the display opening at least in part before pivoting relative to the lower panel section, the central panel portion comprising a reinforcing panel portion positioned against and secured to the lower panel section.

12. A display container according to claim 11 wherein the display opening has first and second side boundaries and wherein the central panel portion is positioned between the first and second side boundaries.

13. A display container according to claim 11 wherein the central panel portion comprises a bottom panel reinforcing portion projecting from the reinforcing panel section.

14. A display container according to claim 13 comprising a plurality of bottom panels coupled to the lower edges of the outer wall panels with a first bottom panel of said bottom panels being coupled to the lower edge of the first outer wall panel, and wherein at least a portion of the bottom panel reinforcing portion abuts the first bottom panel.

15. A display container according to claim 11 wherein the central panel portion comprises an upper edge that abuts the lower edge of the first inner wall panel before pivoting the central panel portion relative to the lower panel section.

16. A display container according to claim 1 made from a single sheet of corrugated paper board.

17. A display container, comprising:

a display container wall, comprising:

an outer wall panel comprising first and second outer wall panel side edges, an outer wall panel top edge and an outer wall panel bottom edge, the outer wall panel also comprising outer wall panel first and second side sections with respective upper and lower edges and an outer wall panel lower panel section with respective upper and lower edges, the outer wall panel comprising a display container opening, the outer wall panel also comprising a central panel portion pivotally coupled to the upper edge of the outer wall panel lower section, the central panel portion comprising a reinforcing panel portion secured to the interior surface of the outer wall panel lower panel section and a bottom panel reinforcing panel portion from the outer panel lower panel section;

an inner wall panel comprising first and second inner wall panel side edges, an inner wall panel top edge and an inner wall panel bottom edge, the inner wall panel also comprising inner wall panel first and second side panel sections with respective upper and lower edges and a detachable panel section between the first and second inner wall panel first and second side panel sections, wherein the detachable panel section partially overlies the display panel opening;

a first hinge coupling the upper edges of the outer and inner wall panel first side sections together and a second hinge coupling the upper edges of the outer and inner wall panel second side sections together, wherein the inner wall panel is foldable at the first and second hinges to position the outer wall first side section against the inner wall first side section and the outer wall second side section against the inner wall second side section, wherein the outer wall first side section is secured to the inner wall first side section and the outer wall second side section is secured to the inner wall second side section;

wherein detachment of the detachable panel section opens the display opening; and wherein the outer wall panel is a first outer wall panel, and the display container further comprises second and third outer wall panels, each with respective exterior and interior wall panel surfaces and upper and lower wall panel edges;

the second outer wall panel being coupled to the first outer wall panel at a first corner and the second outer wall panel being coupled to the third outer wall panel at a second corner;

wherein the inner wall panel is a first inner wall panel, and the display container further comprises second and third inner wall panels, each with a respective exterior and interior wall surface, an upper edge, a lower edge, and first and second opposed side edges;

wherein the exterior surface of the first inner wall panel faces and is secured to the interior surface of the first outer wall panel, the exterior surface of the second inner wall panel faces and is not secured to the interior surface of the second outer wall panel, and the exterior surface of the third inner wall panel faces and is secured to the interior surface of the third outer wall panel;

a first gusset comprising a first gusset top edge and first gusset first and second side edges, wherein the first gusset first side edge is pivoted to the first side edge of the first inner wall panel and the first gusset second side edge is pivoted to the first side edge of the second inner wall panel;

a second gusset comprising a second gusset top edge and second gusset first and second side edges, wherein the second gusset first side edge is pivoted to the first side edge of the third inner wall panel and the second gusset second side edge is pivoted to the second side edge of the second inner wall panel; and wherein the first hinge and the second hinge are pivotal about a hinge pivot axis, and the first, second and third inner wall panels and first and second gussets are pivotal about the hinge pivot axis to position the exterior surfaces of the first, second and third inner wall panels in a position facing the respective interior surfaces of the first, second and third outer wall panels.

18. A display container wall according to claim 17 wherein the detachable panel section has first side edge coupled by a weakened line to the first inner wall side section, wherein the detachable panel section has second side edge coupled by a weakened line to the second inner wall side section, and wherein the detachable panel section has a lower edge portion that abuts at least a portion of the interior surface of the outer wall panel lower panel section.

19. A display container wall according to claim 18 comprising at least one central panel hinge pivotally coupling the central panel portion to the upper edge of the outer wall panel lower section, and wherein the lower edge portion of the detachable panel section is provided with gap at the location of the at least one hinge positioned and sized such that the exterior surface of lower edge of the detachable panel section does not abut the at least one hinge.

20. A display container wall according to claim 18 wherein the reinforcing panel portion comprises an upper edge and the outer wall panel lower panel section comprises an upper edge portion that has an interior surface extending above the upper edge of the of the reinforcing panel portion, the exterior surface of a lower edge portion of the detachable panel section abutting at least a portion of the interior surface of the upper edge portion of the outer wall panel lower panel section prior to removal of the detachable panel section.

21. A display container wall according to claim 17 comprising a first gusset panel coupled to the first side edge of the inner wall panel and a second gusset panel coupled to the second side edge of the inner wall panel.

22. A display container wall according to claim 17 made from a single piece of corrugated paper board.

23. A display container comprising:

an outer wall comprising first and second outer wall panels that oppose one another and that each comprise a top edge, a bottom edge and first and second side edges, wherein the first outer wall panel comprises a display panel opening and comprises first and second outer wall side sections along opposite sides of the display panel opening and a first outer wall lower section, the outer wall also comprising third and fourth outer wall panels that oppose one another and that each comprise a top edge, a bottom edge and first and second side edges, wherein the first, second, third and fourth outer wall panels are coupled together to form four corners of the display container;

an inner wall comprising a first inner wall panel comprising a first inner wall top edge, a first inner wall bottom edge and first and second inner wall side sections, wherein the first inner wall side section is secured to the first outer wall side section and the second inner wall side section is secured to the second outer wall side section, the first inner wall comprising a detachable panel section covering the display panel opening, whereby removal of the detachable panel section opens the display panel opening;

the inner wall comprising a second inner wall panel facing the second outer wall panel and a third inner wall panel facing the third outer wall panel, each of the second and third inner wall panels comprising a top edge, a bottom edge and first and second side edges, a first gusset panel coupling the first side edge of the first inner wall panel to the first side edge of the second inner wall panel and a second gusset panel coupling the first side edge of the of the third inner wall panel to the second side edge of the of the first inner wall panel, a third gusset panel coupled to the second side edge of the second inner wall panel and a fourth gusset panel coupled to the second side edge of the of the third inner wall panel;

the inner wall comprising a fourth inner wall panel section coupled to the third gusset panel and spaced by the third gusset panel from the second inner wall panel, the inner wall panel comprising a fifth inner wall panel section coupled to the fourth gusset panel and spaced by the fourth gusset panel from the third inner wall panel, and wherein the fourth and fifth inner wall panel sections are secured to the fourth outer wall panel; and wherein the gussets are each spaced from a respective adjacent corner of the display container and wherein the second and third inner wall panels are not secured to the second and third outer wall panels.

24. A display container according to claim 23 wherein the fourth outer wall panel comprises first and second outer wall panel sections that are secured together; and wherein the fourth inner wall panel section is secured to the first outer wall panel section and the fifth inner wall panel section is secured to the second outer wall panel section.

25. A display container according to claim 23 comprising a first hinge coupling the top edge of the first outer wall side section to the top edge of the first inner wall side section, the display container also comprising a second hinge coupling the top edge of the second outer wall side section to the top edge of the first inner wall side section.

26. A display container according to claim 25 wherein the only connection between the top edges of the inner wall panels and inner wall panel sections to the top edge of the outer wall panel section is the first and second hinges.

27. A display container according to claim 26 wherein a portion of the display opening is positioned between the first and second hinges.

28. A display container according to claim 23 comprising a plurality of bottom panels each coupled to a respective one of the lower edges of the first, second, third and fourth outer wall panels and wherein each bottom panel comprises an interior surface and an exterior surface.

29. A display container according to claim 28 wherein a first bottom panel of the bottom panels is coupled to the lower edge of the first outer wall panel, and wherein the first outer wall panel comprises a lower panel section and a central panel portion coupled by a fold line to the lower panel section, the central panel portion comprising a reinforcing panel portion secured to the interior surface of the outer wall panel lower panel section and a bottom panel reinforcing panel portion projecting from the reinforcing panel section and is positioned adjacent to the interior surface of the first bottom panel portion.

30. A display container according to claim 29 wherein at least a portion of the bottom panel reinforcing panel portion touches an interior surface of the first bottom panel.

31. A display container according to claim 30 wherein the bottom panel reinforcing panel portion has an exterior surface that abuts the interior surface of at least the first bottom panel.

32. A display container according to claim 29 wherein a gap exists between the bottom panel reinforcing panel portion and the interior surface of the first bottom panel adjacent to the reinforcing panel portion.

33. A display container according to claim 32 wherein the bottom panel reinforcing panel portion comprises a bottom panel reinforcing panel portion gusset positioned to span the gap.

34. A display container according to claim 23 wherein the first outer wall panel comprises a lower panel section and a central panel portion pivotally coupled to the lower panel section, the central panel portion overlying the display opening at least in part before pivoting relative to the lower panel section, the central panel portion comprising a reinforcing panel portion positioned against and secured to the lower panel section.

35. A display container according to claim 34 wherein the display opening has first and second side boundaries and wherein the central panel portion is positioned between the first and second side boundaries.

36. A display container according to claim 34 wherein the central panel portion comprises a bottom panel reinforcing portion projecting from the reinforcing panel section.

37. A display container according to claim 36 comprising a plurality of bottom panels coupled to the lower edges of the outer wall panels with a first bottom panel of said bottom panels being coupled to the lower edge of the first outer wall panel, and wherein at least a portion of the bottom panel reinforcing portion abuts the first bottom panel.

38. A display container according to claim 34 wherein the central panel portion comprises an upper edge that abuts the lower edge of the first inner wall panel before pivoting the central panel portion relative to the lower panel section.

39. A display container according to claim 23 made from a single sheet of corrugated paper board.

40. A single piece corrugated paper board blank for forming a display container comprising:

an outer wall forming portion with weakened lines defining first, second, third and fourth outer wall panels and four corners of the display container when erected, the outer wall forming portion comprising upper and lower container wall edges, the first outer wall panel comprising a central panel portion that defines a display container opening, and wherein the first and fourth wall panels are positioned to oppose one another when the display container is erected and the second and third wall panels are positioned to oppose one another when the container is erected and wherein the outer wall panels have respective exterior and interior wall panel surfaces and the second outer wall panel is coupled to the first outer wall panel at a first corner and the second outer wall panel is coupled to the fourth outer wall panel at a second corner when erected;

an inner wall forming portion with weakened lines defining first, second, third, fourth and fifth inner wall panels, a first gusset panel between the first and second inner wall panels, the first gusset panel comprising a first gusset top edge and first gusset first and second side edges, wherein the first gusset first side edge is pivoted to the first side edge of the first inner wall panel and the first gusset second side edge is pivoted to the first side edge of the second inner wall panel when the display container is erected, a second gusset panel between the first and third inner wall panels, the second gusset panel comprising a second gusset top edge and second gusset first and second side edges, wherein the second gusset first side edge is pivoted to the first side edge of the third inner wall panel and the second gusset second side edge is pivoted to the second side edge of the first inner wall panel when the display container is erected, a third gusset panel between the second and fourth inner wall panels, and a fourth gusset panel between the third and fifth inner wall panels, the inner wall forming portion comprising upper and lower container wall edges, the first inner wall having weakened lines that define a removable panel portion positioned to overlie the display container opening at least in part when the display container is erected and prior to the removal of the removable panel portion to open the display container opening, wherein each gusset panel is positioned to be spaced from and span a respective adjacent corner of the display container when the display container is erected, and wherein the inner wall panels have respective exterior and interior wall surfaces, upper edges, lower edges, and first and second opposed side edges when the display container is erected;

first and second hinge portions coupling the upper edge of the outer wall forming portion to the upper edge of the inner wall forming portion, the first and second hinge portions being spaced apart from one another, the first hinge portion coupling the upper edge of the first outer wall panel to the upper edge of the first inner wall panel when the display container is erected, and wherein the first hinge portion is positioned between the removable panel portion and the first gusset and the second hinge portion is positioned between the removable panel portion and the second gusset, and wherein the first hinge portion is pivotal about a hinge pivot axis, wherein the first, second and third inner wall panels and first and second gussets are pivotal about the hinge pivot axis to position the exterior surfaces of the first, second and third inner wall panels in a position facing the respective interior surfaces of the first, second and third outer wall panels; and wherein, apart from the first and second hinge portions, there are no connections between the outer wall forming portion and the inner wall forming portion that prevent the movement of the gusset panels and second and third inner wall panels relative to the outer wall forming portion during erection of the display container.

41. A corrugated paper board blank according to claim 40 wherein the first outer wall panel comprises a lower panel portion extending from the second wall panel to the third wall panel, the lower panel portion having a lower panel portion upper edge and a lower panel portion lower edge, the central panel portion having a central panel portion upper edge and a central panel portion lower edge, the blank also comprising a pivot coupling the central panel portion lower edge to the lower panel portion upper edge, the central panel portion comprising a weakened line defining a central panel portion reinforcing panel section for positioning against the lower panel portion of the erected container.

42. A corrugated paper board blank according to claim 41 comprising a plurality of bottom forming panels coupled to the lower edge of the outer wall forming panel, and wherein the central panel portion comprises a bottom panel reinforcing portion projecting outwardly from the central panel portion reinforcing panel section for positioning adjacent to and at least partially in contact with at least one of the bottom panels in the erected container.

43. A corrugated paper board blank according to claim 40 comprising a plurality of glue lines on the surface of the outer wall forming panel that forms an interior surface of the display container when erected, the glue lines being positioned to: (i) secure the inner wall forming portion to the outer wall forming portion without connecting the gussets and second and third inner wall panels to the outer wall panels; (ii) to secure the fourth and fifth inner wall panels to the fourth outer wall panel; and (iii) to secure the first inner wall panel to the first outer wall panel outside of the removable panel portion and outside of the central panel portion.

44. A corrugated paper board blank according to claim 40 wherein the fourth wall panel comprises first and second fourth wall panel sections sized to overlap one another when the container is erected.

45. A method of forming a knocked down display container from a corrugated paper board container blank, the blank comprising an outer wall forming portion with interior and exterior surfaces and an inner wall forming portion with interior and exterior surfaces, the outer wall panel forming portion defining four outer wall panels with upper and lower wall panel edges and four corners, a first of the outer wall panels comprising a central portion positioned to define a display container opening through a first of the outer walls, a second of the outer wall panels being coupled to the first outer wall panel at a first corner and the second outer wall panel being coupled to a third of the outer wall panels at a second corner, the inner wall forming portion comprising five inner wall panels with a respective gusset panel between a first and second, between the first and third, between the second and fourth and between the third and fifth of the inner wall panels, the first of the inner wall panels comprising a removable panel portion positioned to overlie the display panel opening in part, the inner wall panels each comprising respective exterior and interior wall surfaces, an upper edge, a lower edge, and first and second opposed side edges, wherein when the display container is erected a first gusset formed from a respective gusset panel comprises a first gusset top edge and first gusset first and second side edges and the first gusset first side edge is pivoted to the first side edge of the first inner wall panel and the first gusset second side edge is pivoted to the first side edge of the second inner wall panel, and a second gusset formed from a respective gusset panel comprises a second gusset top edge and second gusset first and second side edges, wherein the second gusset first side edge is pivoted to the first side edge of the third inner wall panel and the second gusset second side edge is pivoted to the second side edge of the second inner wall panel; the method comprising:

folding a reinforcing panel section of the central portion against an interior surface of a lower panel portion of the first of the outer wall panels with adhesive positioned between the reinforcing panel section and the lower panel portion, the folding of the central portion creating the display container opening through the first of the outer wall panels;

folding the exterior surface of the inner wall forming portion against the interior surface of the outer wall forming portion of the blank, including the first, second, and third inner wall panels and the first and second gussets, about a hinge pivot axis of at least one hinge coupling the upper edge of the first outer wall panel to the upper edge of the first inner wall panel with adhesive positioned at locations between the exterior surface of the inner wall forming portion and the interior surface of the outer wall forming portion other than: (i) between the second and third inner wall panels and the adjacent outer wall panels; and (ii) between the gussets and the adjacent outer wall panels, such that the exterior surface of the first inner wall panel faces and is secured to the interior surface of the first outer wall panel, the exterior surface of the second inner wall panel faces and is not secured to the interior surface of the second outer wall panel, and the exterior surface of the third inner wall panel faces and is secured to the interior surface of the third outer wall panel; and securing the outer wall forming portion together to interconnect the four outer walls and to form a flattened knock down display container.

* * * * *